US011024260B2

(12) United States Patent
Greenebaum

(10) Patent No.: US 11,024,260 B2
(45) Date of Patent: Jun. 1, 2021

(54) ADAPTIVE TRANSFER FUNCTIONS

(71) Applicant: Apple Inc., Cupertino, CA (US)

(72) Inventor: Kenneth I. Greenebaum, San Carlos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/584,412

(22) Filed: Sep. 26, 2019

(65) Prior Publication Data

US 2020/0105226 A1 Apr. 2, 2020

Related U.S. Application Data

(60) Provisional application No. 62/738,937, filed on Sep. 28, 2018, provisional application No. 62/738,946, filed on Sep. 28, 2018.

(51) Int. Cl.

| | |
|---|---|
| ***G09G 5/10*** | (2006.01) |
| ***G09G 5/02*** | (2006.01) |
| ***G09G 5/06*** | (2006.01) |

(52) U.S. Cl.

CPC ..... *G09G 5/10* (2013.01); *G09G 2320/066* (2013.01); *G09G 2320/0613* (2013.01);
(Continued)

(58) Field of Classification Search

CPC ..... G09G 5/10; G09G 2320/066; G09G 2320/0673; G09G 2360/145;
(Continued)

(56) References Cited

U.S. PATENT DOCUMENTS 6,160,655 A 12/2000 Fix
6,987,519 B2 1/2006 Kumada
(Continued)

FOREIGN PATENT DOCUMENTS

WO 2016026072 A1 2/2016

OTHER PUBLICATIONS

Marcu, Gabriel, "Gamut Mapping in Munsell Constant Hue Sections", The Sixth Color Imaging Conference: Color Science, Systems, and Applications, pp. 159-162 (1998).
(Continued)

*Primary Examiner* — Todd Buttram
(74) *Attorney, Agent, or Firm* — Blank Rome LLP

(57) ABSTRACT

The disclosed techniques use a display device, optionally including optical and/or non-optical sensors providing information about the ambient environment of the display device—along with knowledge of the content that is being displayed—to predict a viewer of the display device's current visual adaptation. Using the viewer's predicted adaptation, the content displayed on the display device may be more optimally encoded. This encoding may be accomplished at encode time and may be performed in a display pipeline or, preferably, in the transfer function of the display itself—thereby reducing the precision required in the display pipeline. For example, in well-controlled scenarios where the viewer's adaptation may be fully characterized, e.g., a viewer wearing a head-mounted display (HMD) device, the full dynamic range of the viewer's perception may be encoded in 8 or 9 bits that are intelligently mapped to only the relevant display codes, given the viewer's current predicted adaptation.

20 Claims, 11 Drawing Sheets

(52) U.S. Cl.
CPC . *G09G 2320/0673* (2013.01); *G09G 2320/08* (2013.01); *G09G 2354/00* (2013.01); *G09G 2360/144* (2013.01); *G09G 2360/145* (2013.01)

(58) Field of Classification Search
CPC ..... G09G 2320/0666; G09G 2340/06; G09G 2320/0613; G09G 2320/0261; G09G 2320/08; G09G 2360/144; G09G 2354/00; G09G 5/02; G09G 5/06; G09G 2320/0626; G06T 11/001
See application file for complete search history.

(56) References Cited

U.S. PATENT DOCUMENTS

| | | | |
|---|---|---|---|
| 8,243,210 | B2 | 8/2012 | Bing |
| 8,704,859 | B2 | 4/2014 | Greenebaum |
| 8,954,263 | B2 | 2/2015 | Geelen |
| 9,224,363 | B2 | 12/2015 | Ballestad |
| 9,530,342 | B2 | 12/2016 | Bell |
| 9,583,035 | B2 | 2/2017 | Buckley |
| 10,007,977 | B2 | 6/2018 | Aaron |
| 10,043,251 | B2 | 8/2018 | Huang |
| 2002/0180751 | A1 | 12/2002 | Rozzi |
| 2004/0008208 | A1 | 1/2004 | Dresevic |
| 2005/0117186 | A1 | 6/2005 | Li |
| 2006/0284895 | A1 | 12/2006 | Marcu |
| 2007/0257930 | A1 | 11/2007 | Wade |
| 2008/0080047 | A1 | 4/2008 | Field |
| 2008/0165292 | A1 | 7/2008 | Bing |
| 2008/0303918 | A1 | 12/2008 | Keithley |
| 2009/0141039 | A1 | 6/2009 | Ramanath |
| 2010/0079426 | A1 | 4/2010 | Pance |
| 2010/0124363 | A1 | 5/2010 | Ek |
| 2010/0275266 | A1 | 10/2010 | Jakobson |
| 2011/0074803 | A1* | 3/2011 | Kerofsky ..... G09G 3/3406 345/589 |
| 2011/0141366 | A1 | 6/2011 | Yoon |
| 2011/0285746 | A1 | 11/2011 | Swic |
| 2011/0298817 | A1 | 12/2011 | Oshinome |
| 2013/0071022 | A1 | 3/2013 | Jia |
| 2013/0093783 | A1 | 4/2013 | Sullivan |
| 2014/0082745 | A1 | 3/2014 | Guedalia |
| 2014/0333660 | A1 | 11/2014 | Ballestad |
| 2015/0070337 | A1* | 3/2015 | Bell ..... G09G 3/007 345/207 |
| 2015/0221250 | A1 | 8/2015 | Tada |
| 2016/0110846 | A1 | 4/2016 | Park |
| 2016/0125580 | A1 | 5/2016 | He |
| 2016/0240167 | A1 | 8/2016 | Breazile |
| 2016/0358346 | A1 | 12/2016 | Hendry |
| 2016/0358584 | A1 | 12/2016 | Greenebaum |
| 2017/0116963 | A1 | 4/2017 | Wanat |
| 2017/0161882 | A1 | 6/2017 | Mantiuk |
| 2018/0152686 | A1 | 5/2018 | Wozniak |
| 2019/0384062 | A1* | 12/2019 | Wilson ..... G02F 1/133553 |
| 2020/0105226 | A1* | 4/2020 | Greenebaum ..... G09G 5/10 |

OTHER PUBLICATIONS

Moroney, Nathan, et al., "The CIECAM02 Color Appearance Model", IS&T/SID Tenth Color Imaging Conference, pp. 23-27 (2002).

* cited by examiner

ADAPTIVE TRANSFER FUNCTIONS

CROSS-REFERENCE TO RELATED APPLICATION

This Application is related to U.S. application Ser. No. 12/968,541, entitled, "Dynamic Display Adjustment Based on Ambient Conditions," filed Dec. 15, 2010, and issued Apr. 22, 2014 as U.S. Pat. No. 8,704,859, and which is hereby incorporated by reference in its entirety.

BACKGROUND

Today, consumer electronic devices incorporating display screens are used in a multitude of different environments with different lighting conditions, e.g., the office, the home, home theaters, inside head-mounted displays (HMD), and outdoors. Such devices typically need to be designed to incorporate sufficient display "codes" (i.e., the discrete numerical values used to quantize an encoded intensity of light for a given display pixel) to represent the dimmest representation of content all the way up to the most bright representation—with sufficient codes in between, such that, regardless of the user's visual adaptation at any given moment in time, minimal (or, ideally, no) color banding would be perceivable to the viewer of the displayed content (including gradient content).

The full dynamic range of human vision covers many orders of magnitude in brightness. For example, the human eye can adapt to perceive dramatically different ranges of light intensity, ranging from being able to discern landscape illuminated by star-light on a moonless night (e.g., 0.0001 lux ambient level) to the same landscape illuminated by full daylight (e.g., >10,000 lux ambient level), representing a range of illumination levels on the order of 100,000,000, or 10^8. Linearly encoding this range of human visual perception in binary fashion would require at least log2(100,000,000), or 27 bits (i.e., using 27 binary bits would allow for the encoding of 134,217,728, or 2^27, discrete brightness levels) to encode the magnitudes of the brightness levels—and potentially even additional bits to store codes to differentiate values within a doubling.

At any given visual adaptation to ambient illumination levels, approximately 2^9 brightness levels (i.e., shades of grey) can be distinguished between when placed next to each other, such as in a gradient, to appear continuous. This indicates that roughly, 27+9, or 36 bits would be needed to linearly code the full range of human vision.

It should be mentioned that, while linear coding of images is required mathematically by some operations, it provides a relatively poor representation for human vision, which, similarly to most other human senses, seems to differentiate most strongly between relative percentage differences in intensity (rather than absolute differences). Linear encoding tends to allocate too few codes (representing brightness values) to the dark ranges, where human visual acuity is best able to differentiate small differences leading to banding, and too many codes to brighter ranges, where visual acuity is less able to differentiate small differences leading to a wasteful allocation of codes in that range.

Hence, it is common to apply a gamma encoding (e.g., raising linear pixel values to an exponential power, such as 2.2, which is a simple approximation of visual brightness acuity) as a form of perceptual compressive encoding for content intended for visual consumption (but not intended further editing). For example, camera RAW image data is intended for further processing and is correspondingly often stored linearly at a high bit-depth, but JPEG image data, intended for distribution, display and visual consumption, is gamma encoded using fewer bits.

Generally speaking, content must be viewed in the environment it was authored in to appear correct, which is why motion picture/film content, which is intended to be viewed in a dark theater, is often edited in dark edit suites. When viewed in a different environment, say, content intended for viewing in a dark environment that is viewed in a bright environment instead, the user's vision will be adapted to that bright environment, causing the content to appear to have too high of a contrast as compared to that content viewed in the intended environment, with the codes encoding the lowest brightness levels (i.e., those containing "shadow detail") "crushed" to black, due to the user's vision being adapted to a level where the dimmer codes are undifferentiable from black.

Classically, a gamma encoding optimized for a given environment, dynamic range of content, and dynamic range of display, was developed, such that the encoding and display codes were well spaced across the intended range, so that the content appears as intended (e.g., not banded, without crushed highlights, or blacks, and with the intended contrast—sometimes called tonality, etc.). The sRGB format's 8-bit 2.2 gamma is an example of a representation deemed optimal for encoding SDR (standard dynamic range) content to be displayed on a 1/2.45 gamma rec.709 CRT and viewed in a bright office environment.

However, the example sRGB content, when displayed on its intended rec.709 display, will not have the correct appearance if/when viewed in another environment, either brighter or dimmer, causing the user's adaptation—and thus their perception of the content—to be different from what was intended.

As the user's adaptation changes from the adaptation implied by the suggested viewing environment, for instance to a brighter adaptation, low brightness details may become indistinguishable. At any given moment in time, however, based on current brightness adaptation, a human can only distinguish between roughly 2^8 to 2^9 different brightness levels of light (i.e., between 256-512 so-called "perceptual bins"). In other words, there is always a light intensity value, under which, a user cannot discern changes in light level, i.e., cannot distinguish between low light levels and "true black." Moreover, the combination of current ambient conditions and the current visual adaptation of the user can also result in a scenario wherein the user loses the ability to view the darker values encoded in an image that the source content author both perceived and intended that the consumer of the content be able to perceive (e.g., a critical plot element in a film might involve a knife not quite hidden in the shadows).

As the user's adaptation changes from the adaptation implied by the suggested viewing environment, the general perceived tonality of the image will change, as is described by the adaptive process known as "simultaneous contrast."

As the user's adaptation changes, perhaps because of a change in the ambient light, from the adaptation implied by the suggested viewing environment, the image may also appear to have an unintended color cast, as the image's white point no longer matches the user's adapted white point (for instance, content intended for viewing in D65 light (i.e., bluish cloudy noon-day) will appear too blue when viewed in orange-ish 2700K light (i.e., common tungsten light bulbs)).

As the user's adaptation changes from the adaptation implied by the suggested viewing environment, such as when the user adapts to environmental lighting brighter than the display, e.g., a bright sky, the display's fixed brightness, and environmental light is reflected off the display, the display is able to modulate a smaller range of the user's adapted perception than, say, viewing that same display and content in the dark, where the user's vision will be adapted to the display and potentially able to modulate the user's entire perceptual range. Increasing a display's brightness may cause additional light to "leak" from the display, too, adding to the reflected light, and thus further limiting the darkest level the display can achieve in this environment.

For these factors and more, it is desirable to map the content to the display and, in turn, map the result into the user's adapted vision. This mapping is a modification to the original signal and correspondingly requires additional precision to carry. For instance, consider an 8-bit monotonically incrementing gradient. Even a simple attenuation operation, such as multiplying each value by 0.9, moves most values from 8-bit representable values, thus requiring additional precision to represent the signal with fidelity.

A general approach might be to have the display pipeline that would apply this mapping to adapted vision space implement the full 36-bit linearly-encoded human visual range. However, implementing an image display processing pipeline to handle 36 bits of precision would require significantly more processing resources, more transistors, more wires, and/or more power than would typically be available in a consumer electronic device, especially a portable, light-weight consumer electronic device. Additionally, distributing such a signal via physical media (or via Internet streaming) would be burdensome, especially if streamed wirelessly.

Any emissive, digitally-controlled display technology has minimum and maximum illumination levels that it is capable of producing (and which might be affected by environmental factors, such as reflection), and some number of discrete brightness levels coded in between those limits. These codes have typically been coded to match the transfer function requirements of the media that the display is intended to be used with. As will be described below, some displays also incorporate Look-up Tables (LUTs), e.g., to fine-tune the native response curve of the display to the desired response curve.

Thus, there is a need for techniques to implement a perceptually-aware and/or content-aware system that is capable of utilizing a perceptual model to dynamically adjust a display, e.g., to model what light intensity levels a user's roughly 2^8 to 2^9 discernable perceptual bins are mapping to at any given moment in time, which also correspond to the range of brightness values that the display can modulate, and potentially also intersect with the range of brightness values that the system or media require. Successfully modeling the user's perception of the content data displayed would allow the user's experience of the displayed content to remain relatively independent of the ambient conditions in which the display is being viewed and/or the content that is being displayed, while providing optimal encoding. For instance, if viewing a relatively dim display in a very bright environment, the user's adapted vision is likely much higher than the brightness of the display, and the display's lowest brightness region might even be indistinguishable. Thus, in this situation, it would be expected that fewer than the conventional 8 to 9 bit precision at 2.2 gamma coding would be required to render an image without banding for such a user in such an environment. Moreover, rather than following the conventional approach of adding an extra bit of data to the pipeline for each doubling of the dynamic range to be displayed, such techniques would put a rather modest limit on the number of bits necessary to encode the entire dynamic range of human perception (e.g., the aforementioned 8 or 9 bits), even in the optimal environment, thereby further enhancing the performance and power efficiency of the display device, while not negatively impacting the user's experience or limiting the dynamic range of content that can be displayed.

SUMMARY

As mentioned above, human perception is not absolute; rather, it is relative and adaptive. In other words, a human user's perception of a displayed image changes based on what surrounds the image, the image itself, what content the user has seen in a preceding time interval (which, as will be described herein, can contribute to the user's current visual adaptation), and what range of light levels the viewer's eyes presently differentiate. A display may commonly be positioned in front of a wall. In this case, the ambient lighting in the room (e.g., brightness and color) will illuminate the wall or whatever lies beyond the monitor, influence the user's visual adaptation, and thus change the viewer's perception of the image on the display. In other cases, the user may be viewing the content in a dark theater (or while wearing an HMD). In the theater/HMD cases, the viewer's perception will be adapted almost entirely to the recently-viewed content itself, i.e., not affected by the ambient environment, which they are isolated from. Potential changes in a viewer's perception include a change to adaptation (both physical dilation of the pupil, as well as neural accommodations changing the brightest light that the user can see without discomfort), which further re-maps the perceptual bins of brightness values the user can (and cannot) differentiate (and which may be modeled using a scaled and/or offset gamma function), as well as changes to white point and black point. Thus, while some devices may attempt to maintain an overall identity 1.0 gamma on the eventual display device (i.e., the gamma map from the content's encoded transfer function to the display's electro-optical transfer function, or EOTF), those changes do not take into account the effect on a human viewer's perception of gamma due to differences in ambient light conditions and/or the dynamic range of the recently-viewed content itself.

The techniques disclosed herein use a display device, in conjunction with various optical sensors, e.g., potentially multi-spectral ambient light sensor(s), image sensor(s), or video camera(s), and/or various non-optical sensors, e.g., user presence/angle/distance sensors, time of flight (ToF) cameras, structured light sensors, or gaze sensors, to collect information about the ambient conditions in the environment of a viewer of the display device, as well as the brightness levels on the face of the display itself. Use of these various sensors can provide more detailed information about the ambient lighting conditions in the viewer's environment, which a processor in communication with the display device may utilize to evaluate a perceptual model, based at least in part, on the received environmental information, the viewer's predicted adaptation levels, and information about the display, as well as the content itself that is being, has been, or will be displayed to the viewer. The output from the perceptual model may be used to adapt the content so that, when sent to a given display and viewed by the user in a given ambient environment, it will appear as the source author intended (even if authored in a different environment resulting in a different adaptation). The perceptual model may also be used to directly adapt the display's transfer function, such that the viewer's perception of the content displayed on the display device is relatively independent of the ambient conditions in which the display is being viewed. The output of the perceptual model may comprise modifications to the display's transfer function that are a function of gamma, black point, white point, or a combination thereof. Since adapting content from the nominal intended transfer function of the image/display pipeline requires additional precision (e.g., bits in both representation and processing limits), it may be more efficient to dynamically adapt the transfer function of the entire pipeline and display. In particular, by determining the viewer's adaptation and mapping the display's transfer function and coding to map into the viewer's adaptation, and then directly adapting the content to the display, the adaptation of the content may be performed in a single step operation, e.g., not requiring the display pipeline to perform further adaptation (and thus not requiring extra precision). According to some embodiments, this adaptation of displayed content may be performed as a part of a common color management process (traditionally providing gamma and gamut mapping between source and display space, e.g., as defined by ICC profiles) that is performed on a graphics processing unit (or other processing unit) in high-precision space, and thus not requiring extra processing step. Then, if the modulation range of the display in the user's adapted vision only requires, e.g., 8 bits to optimally describe, the pipeline itself will also only need to run in 8-bit mode (i.e., not requiring extra adaptation, which would require extra bits for extra precision).

The perceptual models disclosed herein may solve, or at least aid in solving, various problems with current display technology, wherein, e.g., content tends to have a fixed transfer function for historic reasons. For instance, in the case of digital movies intended to be viewed in the dark, the user is adapted almost wholly to the content. Thus, the content can have a reasonable dynamic range, wherein sufficient dark codes are still present, e.g., to allow for coverage of brighter scenes. Moreover, when watching a dark scene, the user's adaptation will become more sensitive to darker tones, and there will be too few codes to avoiding banding. Similarly, there may be too few bits available to represent subtle colors for very dim objects (which may sometimes lead to dark complexions in dark scenes being unnaturally rendered in blotches of cyan, magenta, or green—instead of actual skin tones). In another case, e.g., when viewing standard dynamic range (SDR) content when the user is adapted to a much brighter environment, an SDR display simply cannot modulate a perceptually large enough dynamic range (i.e., as compared to that of the original encoding) to maintain the SDR appearance, because the display's modulated brightness range intersects relatively few of the user's perceptual bins (e.g., an 8-bit 2.2 gamma conventional display may have 64 or fewer of the 256 available grey levels be perceptually distinguishable). Techniques such as local tone mapping (LTM), which may introduce the notion of over- and under-shooting pixel values may be applied to sharpen the distinction between elements in certain regions of the display that are deemed to be distinguishable in the content when the content is being viewed on the reference display and in the reference viewing environment.

The static and/or inefficient allocation of display codes leads to either poor performance across a wide array of ambient viewing conditions (such as the exemplary viewing conditions described above) or an increased burden on an image processing pipeline leading to performance, thermal, and reduced battery life issues, due to the additional bits that need to be carried to encode the wider range of output display levels needed to produce a satisfactory high dynamic range viewing experience in a wide array of ambient viewing conditions.

In other embodiments, the content itself may alternatively or additionally be encoded on a per-frame (or per-group-of-frames) basis, thereby taking advantage of the knowledge of the brightness levels and content of, e.g.: previously displayed content, the currently displayed content, and even upcoming content (i.e., content that will be displayed in the near future), in order to more optimally encode the content for the user's predicted current adaptation level. The encoding used (e.g., a parametric description of the transfer function) could be provided for each frame (or group-of-frames), or perhaps only if the transfer function changed beyond a threshold amount, or based on the delta between the current and previous frames' transfer functions. In still other embodiments, the encoding used could potentially be stored in the form of metadata information accompanying one or more frames, or even in a separate data structure describing each frame of group-of-frames. In yet other embodiments, such encoded content may be decoded using the conventional static transfer function (e.g., to be backward compatible), and then use the dynamic transfer function for optimal encoding.

Estimating the user's current visual adaptation allows the system to determine where, within the dynamic range of human vision (and within the capabilities of the display device), to allocate the output codes to best reproduce the output video signal, e.g., in a way that will give the user the benefit of the full content viewing experience, while not 'wasting' codes in parts of the dynamic range of human vision that the user would not even be able to distinguish between at their given predicted adaptation level. For example, as alluded to above, video content that is intended for dim or dark viewing environments could advantageously have a known and/or per-frame transfer function that is used to optimally encode the content based on what the adapted viewer may actually perceive. For instance, in a dark viewing environment where the user is known to be adapted to the content, on a dim scene that was preceded by a very bright scene, it might be predicted based on the perceptual model that the dimmest of captured content codes will be indifferentiable from true black, and, consequently, that known perceptually-crushed region will not even be encoded (potentially via the offset in the encoding and decoding transfer functions). This would allow for fewer overall bits to be used to encode the next frame or number of frames (it is to be understood that the user's adaptation will eventually adapt to the dimmer scene over time or a sufficient number of successive frames with similar average brightness levels) or for the same number of bits to more granularly encode the range of content brightness values that the viewer will actually be able distinguish. In cases where the viewing conditions are static across the entire duration of the rendering of media content (e.g., a movie or a still image), a single optimized transfer function may be determined and used over the duration of the rendering.

Thus, according to some embodiments, a non-transitory program storage device comprising instructions stored thereon is disclosed. When executed, the instructions are configured to cause one or more processors to: receive data indicative of one or more characteristics of a display device; receive data from one or more optical sensors indicative of ambient light conditions surrounding the display device; receive data indicative of one or more characteristics of a content; evaluate a perceptual model based, at least in part, on: the received data indicative of the one or more characteristics of the display device, the received data indicative of ambient light conditions surrounding the display device, the received data indicative of the one or more characteristics of the content, and a predicted adaptation level of a user of the display device, wherein the instructions to evaluate the perceptual model comprise instructions to determine one or more adjustments to a gamma, black point, white point, or a combination thereof, of the display device; adjust a transfer function for the display device based, at least in part, on the determined one or more adjustments; and cause the content to be displayed on the display device utilizing the adjusted transfer function.

In some embodiments, the determined one or more adjustments to the transfer function for the display device are implemented over a determined time interval, e.g., over a determined number of displayed frames of content and/or via a determined number of discrete step changes. In some such embodiments, the determined adjustments are only made when the adjustments exceed a minimum adjustment threshold. In other embodiments, the determined adjustments are made at a rate that is based, at least in part, on a predicted adaptation rate of the user of the display device.

In other embodiments, the aforementioned techniques embodied in instructions stored in non-transitory program storage devices may also be practiced as methods and/or implemented on electronic devices having display, e.g., a mobile phone, PDA, HMD, monitor, television, or a laptop, desktop, or tablet computer.

In still other embodiments, the same principles may be applied to audio data. In other words, by knowing the dynamic range of the audio content and the recent dynamic audio range of the user's environment, the audio content may be transmitted and/or encoded using a non-linear transfer function that is optimized for the user's current audio adaptation level and aural environment.

Advantageously, the perceptually-aware dynamic display adjustment techniques that are described herein may be removed from a device's software image processing pipeline and instead implemented directly by the device's hardware and/or firmware, with little or no additional computational costs (and, in fact, placing an absolute cap on computational costs, in some cases), thus making the techniques readily applicable to any number of electronic devices, such as mobile phones, personal data assistants (PDAs), portable music players, monitors, televisions, as well as laptop, desktop, and tablet computer screens.

DETAILED DESCRIPTION

The disclosed techniques use a display device, in conjunction with various optical and/or non-optical sensors, e.g., ambient light sensors or structured light sensors, to collect information about the ambient conditions in the environment of a viewer of the display device. Use of this information—and information regarding the display device and the content being displayed—can provide a more accurate prediction of the viewer's current adaptation levels. A processor in communication with the display device may evaluate a perceptual model based, at least in part, on the predicted effects of the ambient conditions (and/or the content itself) on the viewer's experience. The output of the perceptual model may be suggested modifications that are used to adjust the scale, offset, gamma, black point, and/or white point of the display device's transfer function, such that, with a limited number of bits of precision (e.g., a fixed number of bits, such as 8 or 9 bits), the viewer's viewing experience is high quality and/or high dynamic range, while remaining relatively independent of the current ambient conditions and/or the content that has been recently viewed.

The techniques disclosed herein are applicable to any number of electronic devices: such as digital cameras, digital video cameras, mobile phones, personal data assistants (PDAs), head-mounted display (HMD) devices, monitors, televisions, digital projectors (including cinema projectors), as well as desktop, laptop, and tablet computer displays.

In the interest of clarity, not all features of an actual implementation are described in this specification. It will of course be appreciated that in the development of any such actual implementation (as in any development project), numerous decisions must be made to achieve the developers' specific goals (e.g., compliance with system- and business-related constraints), and that these goals will vary from one implementation to another. It will be appreciated that such development effort might be complex and time-consuming, but would nevertheless be a routine undertaking for those of ordinary skill having the benefit of this disclosure. Moreover, the language used in this disclosure has been principally selected for readability and instructional purposes, and may not have been selected to delineate or circumscribe the inventive subject matter, with resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

Figure 1:
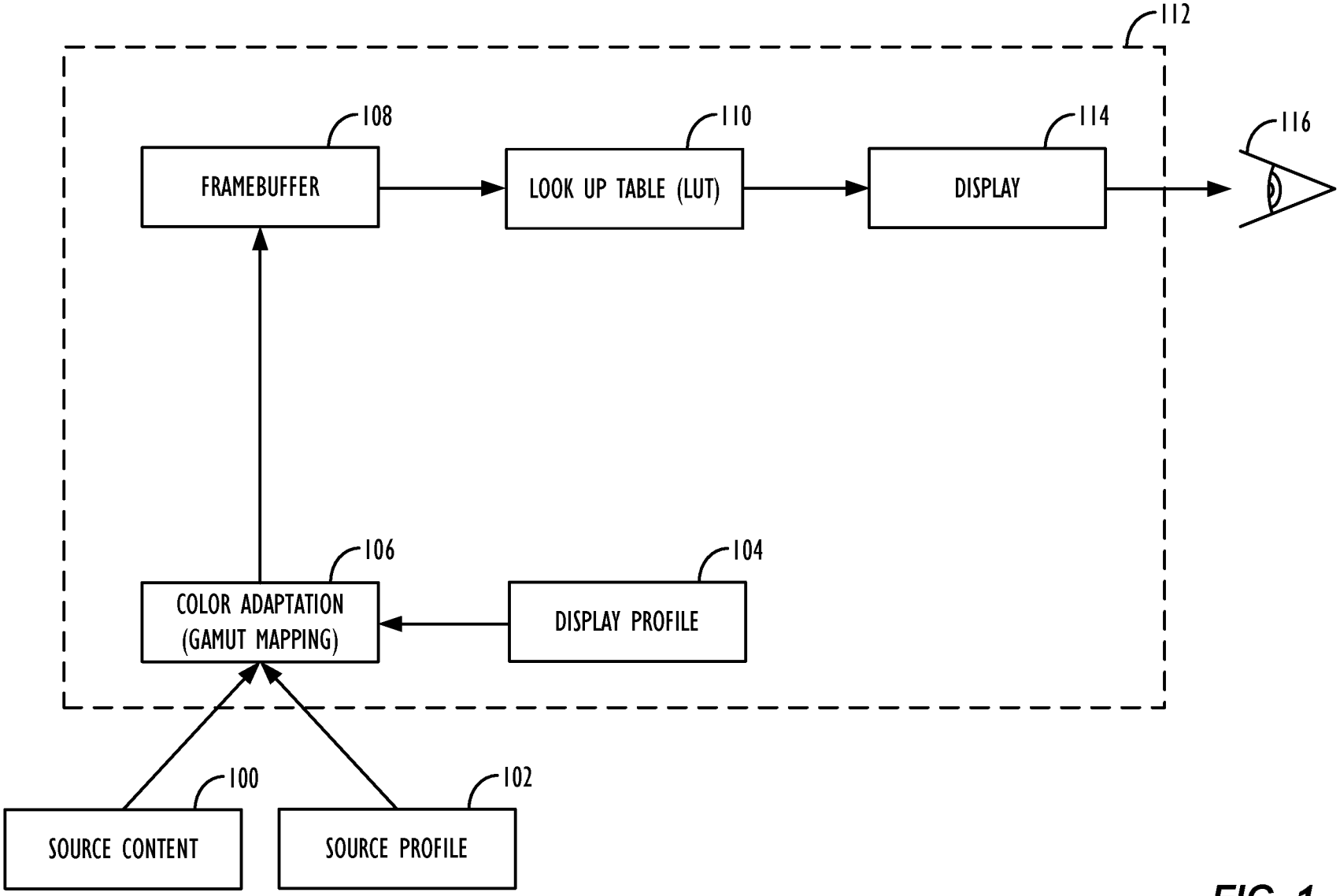
FIG. 1 illustrates a system for performing gamma adjustment utilizing a look up table.

Referring now to FIG. 1, a typical system 112 for performing system gamma adjustment utilizing a Look Up Table (LUT) 110 is shown. Element 100 represents the source content, created by, e.g., a source content author, that viewer 116 wishes to view. Source content 100 may comprise an image, video, or other displayable content type. Element 102 represents the source profile, that is, information describing the color profile and display characteristics of the device on which source content 100 was authored by the source content author. Source profile 102 may comprise, e.g., an ICC profile of the author's device or color space (which will be described in further detail below), or other related information.

Information relating to the source content 100 and source profile 102 may be sent to viewer 116's device containing the system 112 for performing gamma adjustment utilizing a LUT 110. Viewer 116's device may comprise, for example, a mobile phone, PDA, HMD, monitor, television, or a laptop, desktop, or tablet computer. Upon receiving the source content 100 and source profile 102, system 112 may perform a color adaptation process 106 on the received data, e.g., for performing gamut mapping, i.e., color matching across various color spaces. For instance, gamut matching tries to preserve (as closely as possible) the relative relationships between colors (e.g., as authored/approved by the content author on the display described by the source ICC profile), even if all the colors must be systematically mapped from their source to the display's color space in order to get them to appear correctly on the destination device.

Once the source pixels have been color mapped (often a combination of gamma mapping, gamut mapping and chromatic adaptation based on the source and destination color profiles), image values may enter the so-called "framebuffer" 108. In some embodiments, image values, e.g., pixel component brightness values, enter the framebuffer having come from an application or applications that have already processed the image values to be encoded with a specific implicit gamma. A framebuffer may be defined as a video output device that drives a video display from a memory buffer containing a complete frame of, in this case, image data. The implicit gamma of the values entering the framebuffer can be visualized by looking at the "Framebuffer Gamma Function," as will be explained further below in relation to FIG. 2. Ideally, this Framebuffer Gamma Function is the exact inverse of the display device's "Native Display Response" function, which characterizes the luminance response of the display to input.

Because the inverse of the Native Display Response isn't always exactly the inverse of the framebuffer, a LUT, sometimes stored on a video card or in other memory, may be used to account for the imperfections in the relationship between the encoding gamma and decoding gamma values, as well as the display's particular luminance response characteristics. Thus, if necessary, system 112 may then utilize LUT 110 to perform a so-called system "gamma adjustment process." LUT 110 may comprise a two-column table of positive, real values spanning a particular range, e.g., from zero to one. The first column values may correspond to an input image value, whereas the second column value in the corresponding row of the LUT 110 may correspond to an output image value that the input image value will be "transformed" into before being ultimately being displayed on display 114. LUT 110 may be used to account for the imperfections in the display 114's luminance response curve, also known as the "display transfer function." In other embodiments, a LUT may have separate channels for each primary color in a color space, e.g., a LUT may have Red, Green, and Blue channels in the sRGB color space.

The transformation applied by the LUT to the incoming framebuffer data before the data is output to the display device may be used to ensure that a desired 1.0 gamma boost is applied to the eventual display device when considered as a system from encoded source through to display. The system shown in FIG. 1 is generally a good system, although it does not compensate for the user's adaptation (to the display and environment) nor take into account the display's range of brightness compared to the user's adaptation or the effect on the viewer of changes in the dynamic range of the content recently viewed by the viewer. In other words, an experience that is identical to the one the content was authored to be viewed in is only achieved/appropriate in one ambient lighting environment. For example, content captured in a bright environment won't require a gamma boost, e.g., due to the "simultaneous contrast" phenomenon, if viewed in the identical (i.e., bright) environment. Some content is specifically authored for the bright surround (i.e., a nearly 1.0 ratio of reference white display brightness and surround brightness. Most displays with auto-brightness, or user-controlled brightness, are bright surround when used in a greater than dim surround (e.g., greater than 16 lux), but still not too bright of an environment that the display can match (e.g., it may be difficult for an approximately 500 nit display to have the same apparent brightness as daylit surroundings). Some content, e.g., Rec. 709 video, is captured bright surround and then has an implicit over unity system gamma applied to add appropriate boost to compensate for the simultaneous contrast effect when viewed in the intended 16 lux (i.e., approximately 5 nit) dim surround.

As mentioned above, in some embodiments, the goal of this gamma adjustment system 112 is to have an overall 1.0 system gamma applied to the content that is being displayed on the display device 114. An overall 1.0 system gamma corresponds to a linear relationship between the input encoded luma values and the output luminance on the display device 114. Ideally, an overall 1.0 system gamma will correspond to the source author's intended look of the displayed content. However, as will be described later, this overall 1.0 gamma may only be properly perceived in one particular set one set of ambient lighting conditions, thus necessitating the need for an ambient- and perceptually-aware dynamic display adjustment system. As may also now be understood, systems such as that described above with reference to FIG. 1 are actually acting to change the pixel values of the source content received at the system, so as to adapt the content to the display the user is viewing the content on. As will be described in further detail below, a different (and more efficient) approach to display adaptation may be to adapt the transfer function of the display itself (e.g., in a single step operation)—rather than attempt to rewrite the values of all incoming display content.

Figure 2:
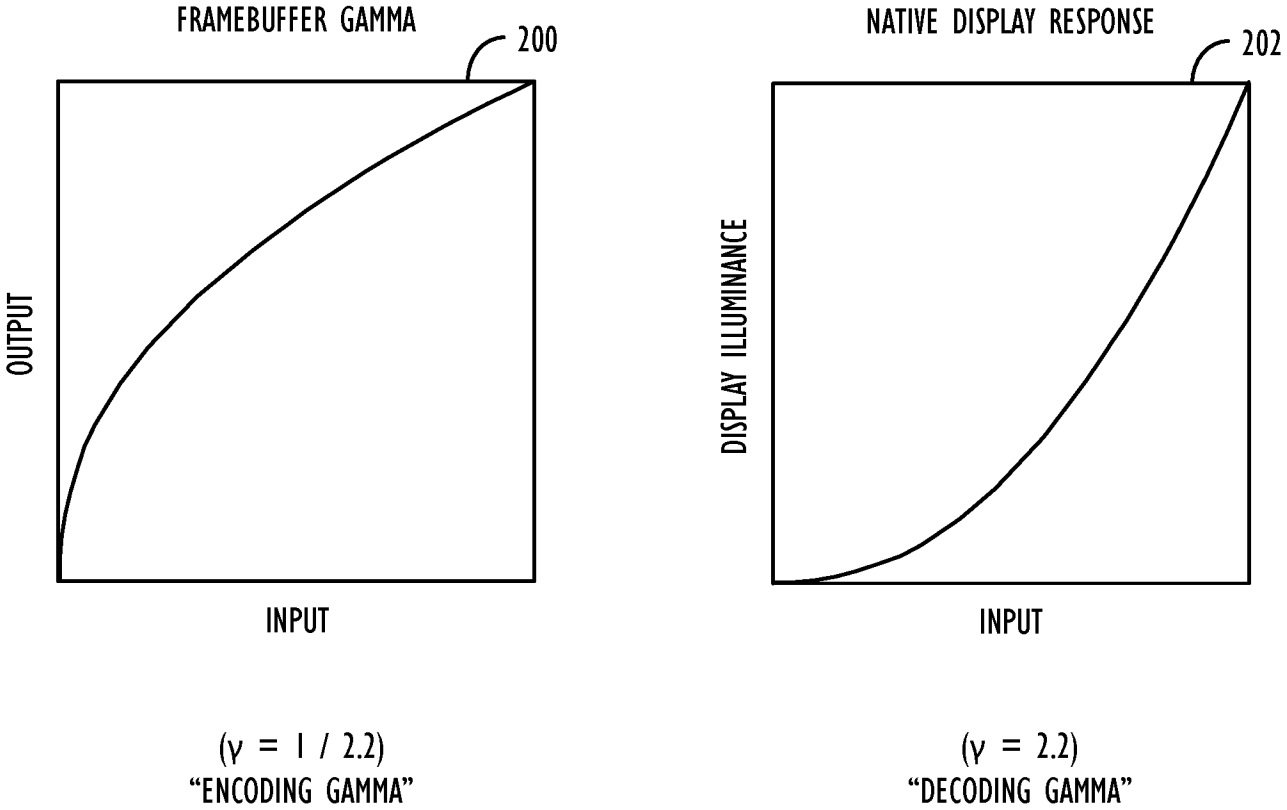
FIG. 2 illustrates a Framebuffer Gamma Function and an exemplary Native Display Response.

Referring now to FIG. 2, a Framebuffer Gamma Function 200 and an exemplary Native Display Response 202 is shown. Gamma adjustment, or, as it is often simply referred to, "gamma," is the name given to the nonlinear operation commonly used to encode luma values and decode luminance values in video or still image systems. Gamma, y, may be defined by the following simple power-law expression: $L_{out}=L_{in}^{Y}$, where the input and output values, $L_{in}$ and $L_{out}$, respectively, are non-negative real values, typically in a predetermined range, e.g., zero to one. A gamma value greater than one is sometimes called an "encoding gamma," and the process of encoding with this compressive power-law nonlinearity is called "gamma compression;" conversely, a gamma value less than one is sometimes called a "decoding gamma," and the application of the expansive power-law nonlinearity is called "gamma expansion."

Gamma encoding of content helps to map the content data into a more perceptually-uniform domain.

Another way to think about the gamma characteristic of a system is as a power-law relationship that approximates the relationship between the encoded luma in the system and the actual desired image luminance on whatever the eventual user display device is. In existing systems, a computer processor or other suitable programmable control device may perform gamma adjustment computations for a particular display device it is in communication with based on the native luminance response of the display device, the color gamut of the device, and the device's white point (which information may be stored in an ICC profile), as well as the ICC color profile the source content's author attached to the content to specify the content's "rendering intent."

The ICC profile is a set of data that characterizes a color input or output device, or a color space, according to standards promulgated by the International Color Consortium (ICC). ICC profiles may describe the color attributes of a particular device or viewing requirement by defining a mapping between the device source or target color space and a profile connection space (PCS), usually the CIE XYZ color space. ICC profiles may be used to define a color space generically in terms of three main pieces: 1) the color primaries that define the gamut; 2) the transfer function (sometimes referred to as the gamma function); and 3) the white point. ICC profiles may also contain additional information to provide mapping between a display's actual response and its "advertised" response, i.e., its tone response curve (TRC), for instance, to correct or calibrate a given display to a perfect 2.2 gamma response.

In some implementations, the ultimate goal of the gamma adjustment process is to have an eventual overall 1.0 gamma boost, i.e., so-called "unity" or "no boost," applied to the content as it is displayed on the display device. An overall 1.0 system gamma corresponds to a linear relationship between the input encoded luma values and the output luminance on the display device, meaning there is actually no amount of gamma "boosting" being applied.

Returning now to FIG. 2, the x-axis of Framebuffer Gamma Function 200 represents input image values spanning a particular range, e.g., from zero to one. The y-axis of Framebuffer Gamma Function 200 represents output image values spanning a particular range, e.g., from zero to one. As mentioned above, in some embodiments, image values may enter the framebuffer 108 already having been processed and have a specific implicit gamma. As shown in graph 200 in FIG. 2, the encoding gamma is roughly 1/2.2, or 0.45. That is, the line in graph 200 roughly looks like the function, $L_{OUT}=L_{IN}^{0.45}$. Gamma values around 1/2.2, or 0.45, are typically used as encoding gammas because the native display response of many display devices have a gamma of roughly 2.2, that is, the inverse of an encoding gamma of 1/2.2. In other cases, a gamma of, e.g., 1/2.45, may be applied to 1.96 gamma encoded (e.g., bright surround) content when displayed on a conventional 1/2.45 gamma CRT display, in order to provide the 1.25 gamma "boost" (i.e., 2.45 divided by 1.96), required to compensate for the simultaneous contrast effect causing bright content to appear low-contrast when viewed in a dim surround (i.e., an environment where the area seen beyond the display, also known as the surround, is dimmer than the reference white of the display, for example, a wall illuminated by a 16 lux environment likely reflects approximately 16/pi, or ~5 nits, and itself might have a reference white as high as 100 nits; 100/5 is a display to surround ratio of 20:1 and is generally considered to be a dim surround).

The x-axis of Native Display Response Function 202 represents input image values spanning a particular range, e.g., from zero to one. The y-axis of Native Display Response Function 202 represents output image values spanning a particular range, e.g., from zero to one. In theory, systems in which the decoding gamma is the inverse of the encoding gamma should produce the desired overall 1.0 system gamma. However, this system does not take into account the effect on the viewer's perception due to, e.g., ambient light in the environment around the display device and/or the dynamic range of recently-viewed content on the display. Thus, the desired overall 1.0 system gamma is only achieved in one ambient lighting environment, e.g., one equivalent to the authoring lighting environment, and this environment is typically brighter than normal office or workplace environments.

Figure 3:
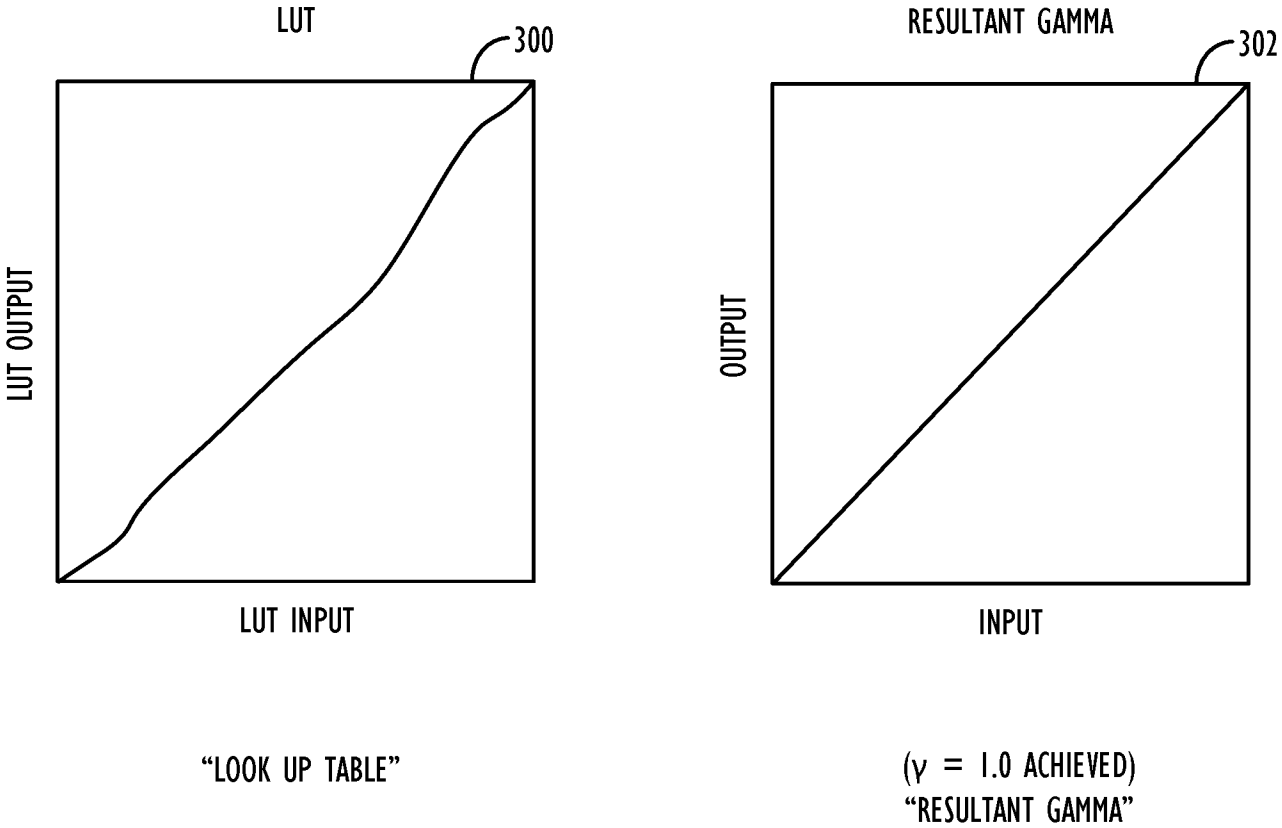
FIG. 3 illustrates graphs representative of a LUT transformation and a Resultant Gamma Function.

Referring now to FIG. 3, graphs representative of a LUT transformation and a Resultant Gamma Function are shown. The graphs in FIG. 3 show how, in an ideal system, a LUT may be utilized to account for the imperfections in the relationship between the encoding gamma and decoding gamma values, as well as the display's particular luminance response characteristics at different input levels. The x-axis of native display response graph 300 represents input image values spanning a particular range, e.g., from zero to one. The y-axis of native display response graph 300 represents output image values spanning a particular range, e.g., from zero to one. The non-straight line nature of graph 300 represents the minor peculiarities and imperfections in the exemplary display's native response function. The x-axis of LUT graph 302 represents input image values spanning the same range of input values the display is capable of responding to, e.g., from zero to one. The y-axis of LUT graph 302 represents the same range of output image values the display is capable of producing, e.g., from zero to one. In an ideally calibrated display device, the display response 300 will be the inverse of the LUT response 302, such that, when the LUT graph is applied to the input image data, the Resultant Gamma Function 304 reflects a desired overall system 1.0 gamma response, i.e., resulting from the adjustment provided by the LUT and the native (nearly) linear response of the display. The x-axis of Resultant Gamma Function 304 represents input image values as authored by the source content author spanning a particular range, e.g., from zero to one. The y-axis of Resultant Gamma Function 304 represents output image values displayed on the resultant display spanning a particular range, e.g., from zero to one. The slope of 1.0, reflected in the line in graph 304, indicates that luminance levels intended by the source content author will be reproduced at corresponding luminance levels on the ultimate display device.

Figure 4A:
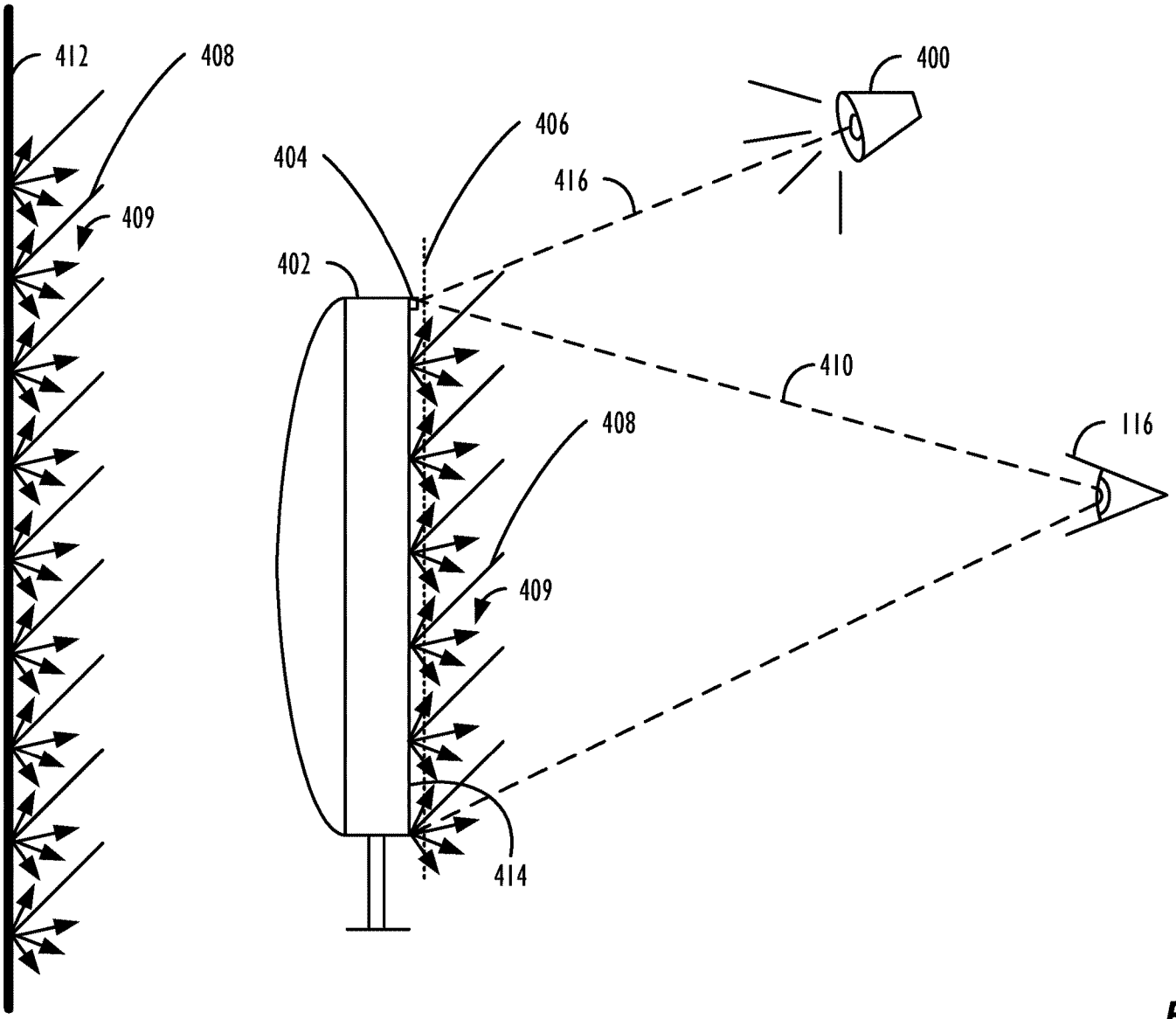
FIG. 4A illustrates the properties of ambient lighting and diffuse reflection off a display device.

Referring now to FIG. 4A, the properties of ambient lighting and diffuse reflection off a display device are shown via the depiction of a side view of a viewer 116 of a display device 402 in a particular ambient lighting environment. As shown in FIG. 4A, viewer 116 is looking at display device 402, which, in this case, is a typical desktop computer monitor. Dashed lines 410 represent the viewing angle of viewer 116. The ambient environment as depicted in FIG. 4A is lit by environmental light source 400, which casts light rays 408 onto all of the objects in the environment, including wall 412 as well as the display surface 414 of display device 402. As shown by the multitude of small arrows 409 (representing reflections of light rays 408), a certain percentage of incoming light radiation will reflect back off of the surface that it shines upon.

One phenomenon in particular, known as diffuse reflection, may play a particular role in a viewer's perception of a display device. Diffuse reflection may be defined as the reflection of light from a surface such that an incident light ray is reflected at many angles. Thus, one of the effects of diffuse reflection is that, in instances where the intensity of the diffusely reflected light rays is greater than the intensity of light projected out from the display in a particular region of the display, the viewer will not be able to perceive tonal details in those regions of this display. This effect is illustrated by dashed line 406 in FIG. 4A. Namely, intended light from the emissive display surface 414, including light leaked from the display and ambient light reflected off the face of the display, will add together. Thus, there may be a baseline brightness level (406) that the display cannot be dimmer than (this level is also referred to herein as the "pedestal" of the display).

Thus, in one or more embodiments disclosed herein, a perceptually-aware model for dynamically adjusting a display's transfer function may reshape the response curve for the display, such that the display's dimmest color codes, with the addition of unwanted light, aren't moved into an area of less perceptual acuity and thus can't be differentiated. In some instances, local tone mapping (LTM) techniques may be employed, which, as described above, may introduce the notion of over- and under-shooting of pixel values to sharpen the distinction between elements in certain regions of the display that are deemed to be distinguishable in the content when the content is being viewed on the reference display and in the reference viewing environment. Further, there is more diffuse reflection off of non-glossy displays than there is off of glossy displays, and the perceptual model may be adjusted accordingly for display type. The predictions of diffuse reflection levels input to the perceptual model may be based off of light level readings recorded by one or more optical sensors, e.g., an ambient light sensor 404, and/or non-optical sensors. Dashed line 416 represents data indicative of the light source being collected by ambient light sensor 404. Ambient light sensor 404 may be used to collect information about the ambient conditions in the environment of the display device and may comprise, e.g., an ambient light sensor, an image sensor, or a video camera, or some combination thereof. A front-facing image sensor, i.e., one on the front face of the display, may provide information regarding how much light (and, possibly, what color of light) is hitting the display surface. This information may be used in conjunction with a model of the reflective and diffuse characteristics of the display to determine where to move the black point for the brightness setting of the display, the content being displayed, and the particular lighting conditions that the display is currently in and that the user is currently adapted to. Although ambient light sensor 404 is shown as a "front-facing" image sensor, i.e., facing in the general direction of the viewer 116 of the display device 402, other optical sensor types, placements, positioning, and quantities are possible. For example, one or more "back-facing" image sensors alone (or in conjunction with one or more front-facing sensors) could give even further information about light sources and the color in the viewer's environment. The back-facing sensor picks up light re-reflected off objects behind the display and may be used to determine the brightness of the display's surroundings, i.e., what the user sees beyond the display. This information may also be used to modify the display's transfer function. For example, the color of wall 412, if it is close enough behind display device 402 could have a profound effect on the viewer's perception. Likewise, in the example of an outdoor environment, the color and intensity of light surrounding the viewer can make the display appear different than it would an indoor environment with, say, incandescent (colored) lighting. Thus, in some embodiments, what the user sees beyond the display may be approximated using the back-facing sensor(s), the geometry of the viewer's (likely) distance from the display, and/or the size of the display based on a color appearance model, such as CIECAM02.

In one embodiment, an optical sensor 404 may comprise a video camera (or other devices) capable of capturing spatial information, color information, as well as intensity information. With regard to spatial information, a video camera or other device(s) may also be used to determine a viewing user's distance from the display, e.g., to further model how much of the user's field of view the display fills and, correspondingly, how much influence the display/environment will have on the user's adaptation. Thus, utilizing a video camera could allow for the creation of an ambient model that could adapt not only the gamma, and black point of the display device, but also the white point of the display device. This may be advantageous, e.g., due to the fact that a fixed white point system is not ideal when displays are viewed in environments of varying ambient lighting levels and conditions. In some embodiments, a video camera may be configured to capture images of the surrounding environment for analysis at some predetermined time interval, e.g., every ten seconds, and then smoothly animate transitions, thus allowing the ambient model to be updated in imperceptible steps as the ambient conditions in the viewer's environment change.

Additionally, a back-facing video camera intended to model the surround could be designed to have a field of view roughly consistent with the calculated or estimated field of view of the viewer of the display. Once the field of view of the viewer is calculated or estimated, e.g., based on the size or location of the viewer's facial features as recorded by a front-facing camera, assuming the native field of view of the back-facing camera is known and is larger than the field of view of the viewer, the system may then determine what portion of the back-facing camera image to use in the surround computation.

In still other embodiments, one or more cameras or depth sensors may be used to further estimate the distance of particular surfaces from the display device. This information could, e.g., be used to further inform a perceptual model of the likely composition of the viewer's surround and the perceptual impacts thereof. For example, a display with a 30" diagonal sitting 18" from a user will have a greater influence on the user's vision than the same display sitting 48" away from the user (thus filling less of the user's field of view).

Figure 4B:
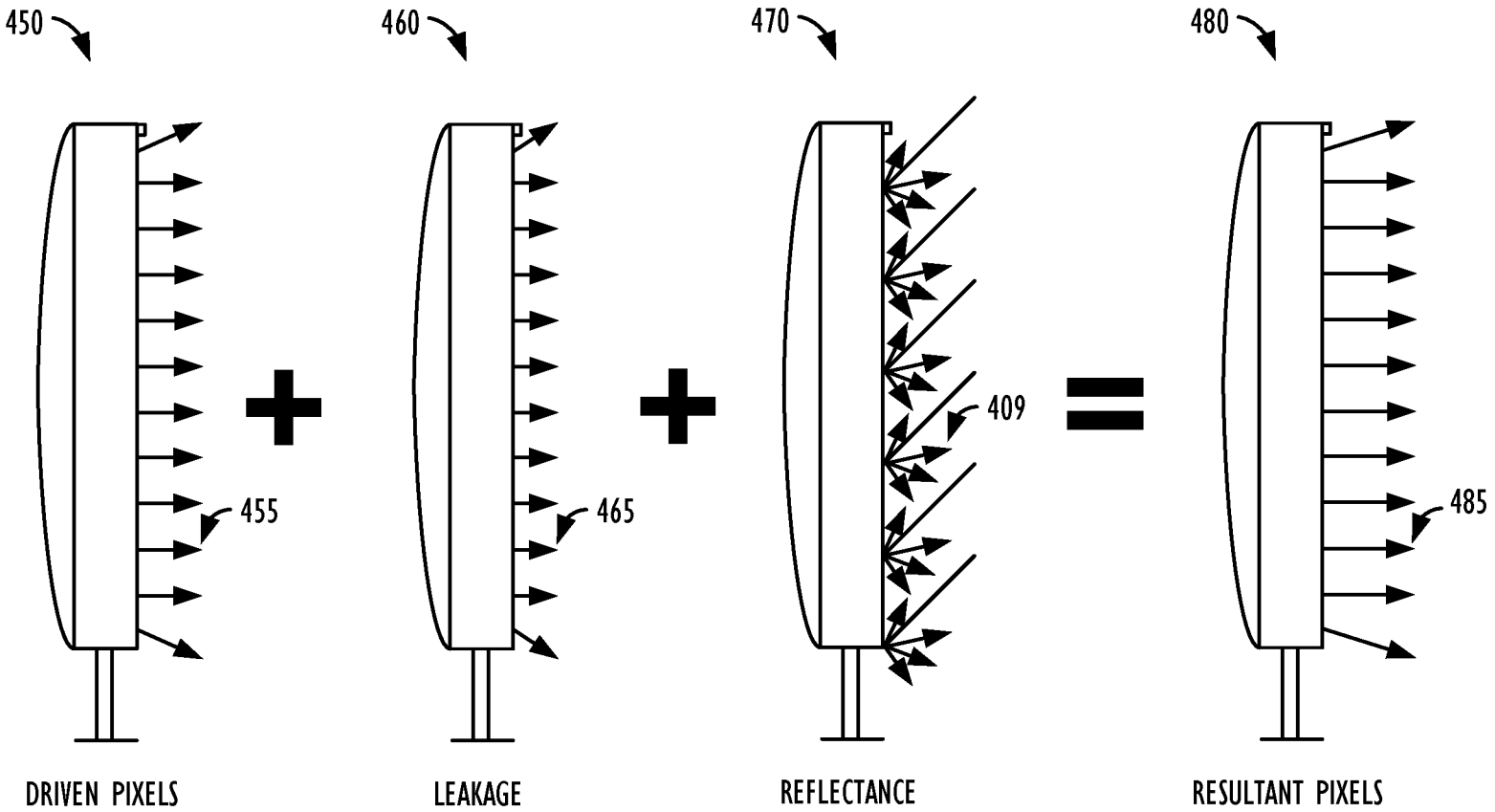
FIG. 4B illustrates the additive effects of unintended light on a display device.

Referring now to FIG. 4B, another illustration of the additive effects of unintended light on a display device is shown. For example, the light rays 455 emitting from display representation 450 represent the amount of light that the display is intentionally driving the pixels to produce at a given moment in time. Likewise, light rays 465 emitting from display representation 460 represent the amount of light leakage from the display at the given moment in time, and light rays 409 reflecting off display representation 470 represent the aforementioned reflectance of ambient light rays off the surface of the display at the given moment in time. Finally, display representation 480 represents the summation of the three forms of light illustrated in display representations 450, 460, and 470. As illustrated in FIG. 4B, the light rays 485 emitting from display representation 480 represent the actual amount of light that will be perceived by a viewer of the display device at a given moment in time, which amount is, as explained above, different than the initial amount of light 455 the display was intentionally driven with to produce the desired content at the given moment in time. Thus, accounting for the effects of these various phenomenon may help to achieve a more consistent and content-accurate perceptual experience for a user viewing the display.

Figure 5:
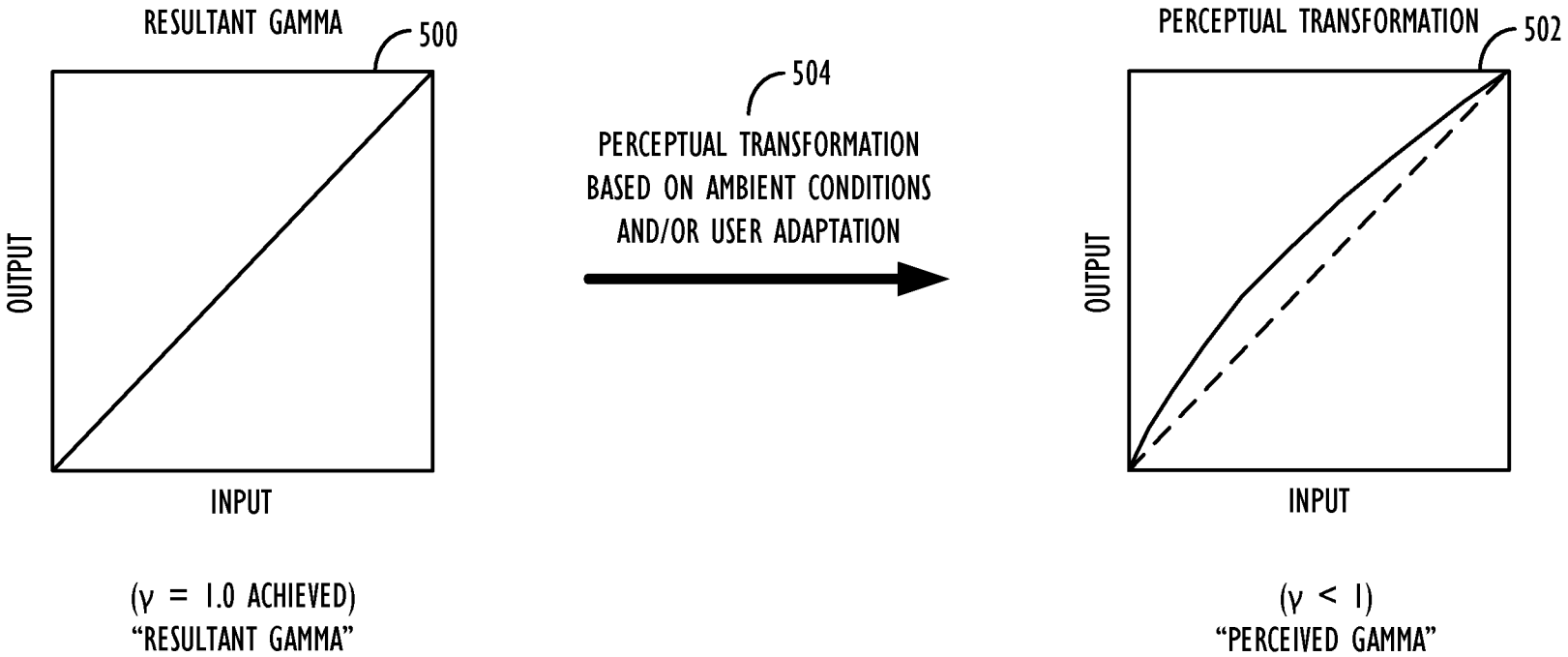
FIG. 5 illustrates a resultant gamma function and a graph indicative of a perceptual transformation.

Referring now to FIG. 5, a Resultant Gamma Function 500 and a graph indicative of a perceptual transformation caused by ambient conditions and/or predicted user adaptation 502 are shown. As mentioned above in reference to graph 304 in FIG. 3, ideally, the Resultant Gamma Function 500 reflects a desired overall 1.0 system gamma on the resultant display device. The slope of 1.0 reflected in the line in graph 500 indicates that the tone response curves (i.e., gamma) are matched between the source and the display, and that the image on the display is likely being displayed more or less as the source's author intended. However, this calculated overall 1.0 system gamma does not take into account the effect on the viewer's perception, e.g., due to differences in ambient light conditions. In other words, due to perceptual transformations that are caused by ambient conditions in the viewer's environment 504, the viewer does not perceive the desired overall 1.0 gamma in all lighting conditions. The calculated overall 1.0 gamma may further fail to take into account the effect on the viewer's current adaptation to the ambient light conditions. As described above, a user's ability to perceive changes in light intensity (as well as the overall range of light intensities that their eyes may be able to perceive) is further based on what levels of light the user's eyes have been around (and thus adjusted to) over a preceding window of time (e.g., 30 seconds, 5 minutes, 15 minutes, etc.)

As is shown in graph 502, the dashed line indicates an overall 1.0 gamma boost, whereas the solid line indicates the viewer's actual perception of gamma, which corresponds to an overall gamma boost that is not equal to 1.0. Thus, a perceptually-aware model for dynamically adjusting a display's characteristics according to one or more embodiments disclosed herein may be able to account for the perceptual transformation based on the viewer's ambient conditions and/or recently-viewed content, and thus present the viewer with what he or she will perceive as the desired overall 1.0 system gamma. As explained in more detail below, such perceptually-aware models may also have a non-uniform time constant for how stimuli over time affect the viewer's instantaneous adaptation. In other words, the model may attempt to predict the rate of a user's adaptation based on the accumulative effects that the viewer's ambient conditions may have had on their adaptation over time.

Figure 6:
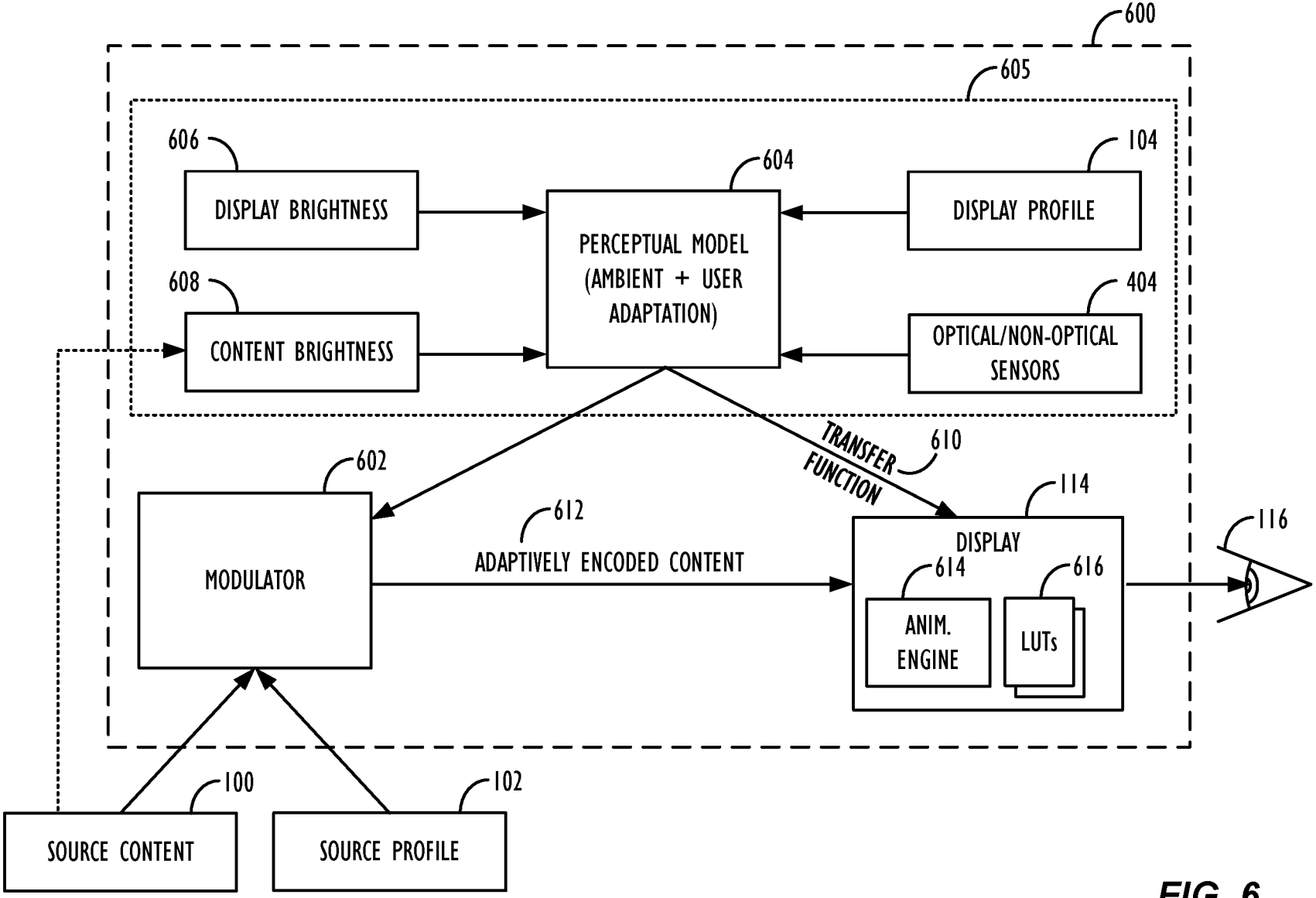
FIG. 6 illustrates a system for performing perceptually-aware dynamic display adjustment, in accordance with one or more embodiments.

Referring now to FIG. 6, a system 600 for performing perceptually-aware dynamic display adjustment is illustrated, in accordance with one or more embodiments. The system depicted in FIG. 6 is similar to that depicted in FIG. 1, with the addition of modulator 602 and perceptual model 604 and, in some embodiments, an animation engine 614 in display 114. A given display, e.g., display 114, may be said to have the capability to "modulate" (that is, adapt or adjust to) only a certain percentage of a viewer's adapted vision range at a given moment in time. For instance, if the user is adapted to an environment much brighter than the display, and the display is reflecting a lot of light at its minimum display output level, then the display may have a relatively high "pedestal" value, and thus, even at its maximum display output level, only be able to modulate a fraction of a user's visual adaptation.

Modulator 602 may thus be used to determine how to warp the source content 100 (e.g., high precision source content) into the display's visual display space. As described above, warping the original source content signal for the display may be based, e.g., on the predicted adapted human vision levels received from perceptual model 604. This may mean skipping display codes that the perceptual model predicts that viewers will be unable to distinguish between at their current adaptation levels. According to some embodiments, the modulator 602 may also apply a content-based transform to the source content (e.g., in instances when the source content itself has been encoded with a per-frame or per-group-of-frames transfer function), resulting in the production of an adaptively encoded content signal 612. In some embodiments, modulator 602 may also be used to determine how to warp the contents of one or more display calibration LUTs (e.g., to move black point or change the gamma of the display), such that, the correction for, say, display code '20' being a little weak on a given display, is maintained after the various determined adjustments are implemented by the perceptual model. A more naïve compression approach, by contrast, will either lose (or corrupt) this particular knowledge about the peculiarities of display code 20 on the given display. It is to be understood that the description of using one or more LUTs to implement the modifications determined by the perceptual model is just one exemplary mechanism that may be employed to control the display's response. For example, tone mapping curves (including local tone mapping curves) and/or other bespoke algorithms may be employed for a given implementation.

As illustrated within dashed line box 605, perceptual model 604 may take various factors and source of information into consideration, e.g.: information indicative of ambient light conditions obtained from one more optical and/or non-optical sensors 404 (e.g., ambient light sensors, image sensors, ToF cameras, structured light sensors, etc.); information indicative of the display profile 104's characteristics (e.g., an ICC profile, an amount of static light leakage for the display, an amount of screen reflectiveness, a recording of the display's 'first code different than black,' a characterization of the amount of pixel crosstalk across the various color channels of the display, etc.); the display's brightness 606; and/or the displayed content's brightness 608. The perceptual model 604 may then evaluate such information to predict the effect on the viewer's perception due to ambient conditions and adaptation and/or suggest modifications to improve the display device's tone response curve for the viewer's current adaptation level.

The result of perceptual model 604's evaluation may be used to determine a modified transfer function 610 for the display. The modified transfer function 610 may comprise a modification to the display's white point, black point, and/or gamma, or a combination thereof. For reference, "black point" may be defined as the lowest level of light to be used on the display in the current ambient environment (and at the user's current adaptation), such that the lowest images levels are distinguishable from each other (i.e., not "crushed" to black) in the presence of the current pedestal level (i.e., the sum of reflected and leaked light from the display). "White point" may be defined as the color of light (e.g., as often described in terms of the CIE XYZ color space) that the user, given their current adaptation, sees as being a pure/neutral white color.

In some embodiments, the modifications to the display's transfer function may be implemented via the usage of a parametric equation, wherein the parameters affecting the modified transfer function 610 include the aforementioned display white point, black point, and gamma. In some embodiments, the parametric equation might accept one or more pixel values for each pixel output it solves for (e.g., the equation may take the values of one or more neighboring pixels into account when solving for a given pixel). Using a parameterized equation may allow the changes to the transfer function to be specified in a 'lightweight' fashion (e.g., only needing to transmit the changed values of the parameters from the perceptual model 604 to the display 114) and easily allowing the transfer function to change gradually over time, if so desired. Next, according to some embodiments, system 600 modifies one or more LUTs 616, such as may be present in display 114, to implement the modified transfer function 610. After modification, LUTs 616 may serve to make the display's transfer function adaptive and "perceptually-aware" of the viewer's adaptation to the ambient conditions and the content that is being, has been, or will be viewed. (As mentioned above, different mechanisms, i.e., other than LUTs, may also be used to adapt the display's transfer function, e.g., tone mapping curves or other bespoke algorithms designed for a particular implementation.)

In some embodiments, the modifications to LUTs 616 may be implemented gradually (e.g., over a determined interval of time) by a suitable mechanism, e.g., animation engine 614. According to some such embodiments, animation engine 614 may be configured to adjust the LUTs 616 based on the rate at which it is predicted the viewer's vision will adapt to the changes. For example, in some embodiments, the animation engine 614 may attempt to match its changes to the LUTs 616 to the predicted rate of change in the viewer's perception. In still other embodiments, a threshold for change in viewer perception may be employed, below which changes to the LUTs 616 need not be made, e.g., because they might not be noticeable or significant to the user. Further, when it is determined that changes to the LUTs 616 should be made, according to some embodiments, animation engine 614 may determine the duration over which such changes should be made and/or the 'step size' for the various changes, such that each individual step is unnoticeable and thus will not cause the display to have any unwanted flashing or strobing.

More particularly, in some embodiments, the perceptual model may provide an estimate of how much adaptation of the display is needed, e.g., in terms of a perceptual distance unit, ΔE. If the perceptual distance calculated by the perceptual model is less than a threshold value, $d_{thresh}$, then the display's transfer function may not be updated. If the perceptual distance is greater than the threshold value, $d_{thresh}$, then the animation engine 614 may determine how many steps to take to adapt the display as determined by the perceptual model. For example, in some embodiments, the display may not be moved by more than 0.5ΔE per step. Thus, if the distance calculated by the perceptual model is 2ΔE, the display may make the necessary adjustments over 4 steps. In other embodiments, the rate at which the determined step changes to the display's transfer function are to be made may also be determined by animation engine 614. For example, in some embodiments, one step may be taken for every 'n' frames that are displayed. In other embodiments, the rate at which the animation engine 614 adapts the display may be based on human perception, i.e., the predicted rate at which the human visual system (HVS) is able to adapt to changes in a certain environment. For example, if it is predicted that the HVS would take 15 seconds to adapt to a particular adaptation, the animation engine 614 may update the display's transfer function smoothly over the course of 15 seconds, such that the display is finished adapting itself by the time the human viewer is predicted to be able to perceive such adaptations.

In some embodiments, the black level for a given ambient environment is determined, e.g., by using an ambient light sensor or by taking measurements of the actual panel and/or diffuser of the display device. As mentioned above in reference to FIG. 4A, diffuse reflection of ambient light off the surface of the device may add to the intended display values and affect the user's ability to perceive the darkest display levels (a phenomenon also known as "black crush"). In other environments, light levels below a certain brightness threshold will simply not be visible to the viewer. Once this level is determined, the black point may be adjusted accordingly. For example, the system 600 may not assign any display codes to perceptual bins at or lower than the determined black point, instead determining to assign its limited number of display codes (e.g., the aforementioned 2^8 or 2^9 codes) only to areas where the viewer would actually be able to perceive changes in brightness (while also intelligently assigning codes more densely in ranges of brightness where the viewer is predicted to have greater levels of acuity).

In another embodiment, the white point, i.e., the color a user perceives as white for a given ambient environment, may be determined similarly, e.g., by using one or more optical sensors 404 to analyze the lighting and color conditions of the ambient environment. The white point for the display device may then be adapted to be the determined white point from the viewer's surround. Additionally, it is noted that modifications to the white point may be asymmetric between the LUT's Red, Green, and Blue channels, thereby moving the relative RGB mixture, and hence the white point.

In another embodiment, a color appearance model (CAM), such as the CIECAMO2 color appearance model, may further inform the perceptual model regarding the appropriate amount of gamma boost to apply with the display's modified transfer function. The CAM may, e.g., be based on the brightness and white point of the viewer's surround, as well as the field of view of the display subtended by the viewer's field of vision. In some embodiments, knowledge of the size of the display and the distance between the display and the viewer may also serve as useful inputs to the perceptual model 604. Information about the distance between the display and the user could be retrieved from a front-facing image sensor, such as front-facing camera 404. For example, for pitch black ambient environments, an additional gamma boost of about 1.5 imposed by the LUT may be appropriate, whereas a 1.0 gamma boost (i.e., unity, or no boost) may be appropriate for a bright or sun-lit environment. For intermediate surrounds, appropriate gamma boost values to be imposed by the LUT may be interpolated between the values of 1.0 and about 1.5. A more detailed model of surround conditions is provided by the CIECAMO2 specification.

In the embodiments described immediately above, the LUTs 616 may serve as a useful and efficient place for system 600 to impose these perceptually-based display transfer function adaptations. It may be beneficial to use the LUTs 616 to implement these perceptually-based display transfer function adaptations because the LUTs: 1) are easily modifiable, and thus convenient; 2) are configured to change properties for the entire display device; 3) can work with high precision content data without adding any additional hardware or runtime overhead to the system; and 4) are already used to carry out similar style transformations for other purposes, as described above. In other words, by adapting the changes or "steps" in output intensity directly in the display's transfer function itself (e.g., based on the output of the perceptual model), the signal data no longer has to be edited in the image processing pipeline (e.g., by changing the actual pixel values being rendered so as to adapt the values to whatever environment the user is in when viewing the content), which typically requires greater precision (e.g., via the use of more bits) to implement.

Figure 7:
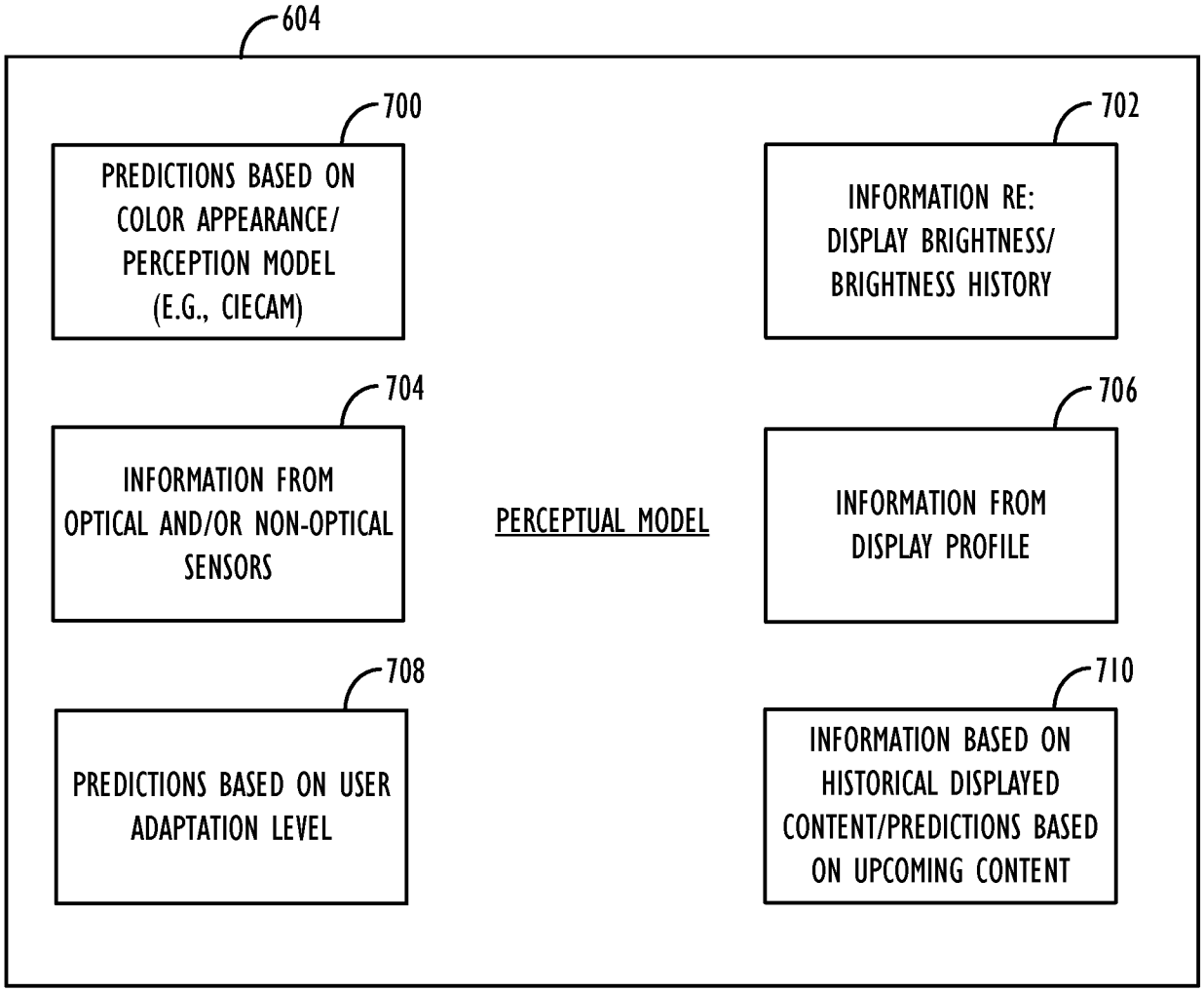
FIG. 7 illustrates a simplified functional block diagram of a perceptual model, in accordance with one or more embodiments.

Referring now to FIG. 7, a simplified functional block diagram of perceptual model 604 is shown. As is shown in FIG. 7, the perceptual model 604 may consider: predictions from a color appearance model 700; information regarding the display's current brightness level and/or brightness history 702 (e.g., knowing how bright the display has been and for how long may influence the user's adaptation level); information from optical and/or non-optical sensors 704; information and characteristics from the display profile 706; predictions based on user adaptation level 708; and/or information based on historically displayed content/predictions based on upcoming content 710.

Color appearance model 700 may comprise, e.g., the CIECAMO2 color appearance model or the CIECAM97s model. Color appearance models may be used to perform chromatic adaptation transforms and/or for calculating mathematical correlates for the six technically defined dimensions of color appearance: brightness (luminance), lightness, colorfulness, chroma, saturation, and hue.

Display profile 706 information may comprise information regarding the display device's color space, native display response characteristics or abnormalities, reflectiveness, leakage, or even the type of screen surface used by the display. For example, an "anti-glare" display with a diffuser will "lose" many more black levels at a given (non-zero) ambient light level than a glossy display will.

Historical model 710 may take into account both the instantaneous brightness levels of content and the cumulative brightness of content a viewer has viewed over a period of time. In other embodiments, the model 710 may also perform an analysis of upcoming content, e.g., to allow the perceptual model to begin to adjust a display's transfer function over time, such that it is in a desired state by the time (or within a threshold amount of time) that the upcoming content is displayed to the viewer. The biological/chemical speeds of visual adaptation in humans may also be considered when the perceptual model 604 determines how quickly to adjust the display to account for the upcoming content. In some cases, content may itself already be adaptively encoded, e.g., by the source content creator. For example, one or more frames of the content may include a customized transfer function associated with respective frame or frames. In some embodiments, the customized transfer function for a given frame may be based only on the given frame's content, e.g., a brightness level of the given frame. In other embodiments, the customized transfer function for a given frame may be based, at least in part, on at least one of: a brightness level of one or more frames displayed prior to the one or more frames of content; and/or a brightness level of one or more frames displayed after the one or more frames of content. In cases where the content itself has been adaptively encoded, the perceptual model 604 may attempt to further modify the display's transfer function during the display of particular frames of the encoded content, e.g., based on the other various environment factors, e.g., 702/704/708, that may have been obtained at the display device.

In some embodiments, e.g., those in which the content itself is adaptively encoded (e.g., in the form of a per-frame or per-group-of-frames transfer function), there may be no need to allocate encoding codes for certain brightness ranges (and/or color ranges), thus requiring even fewer bits of precision to represent the content in the display pipeline. For example, in a case where an encoded frame of content comprises entirely dim content (and the user is adapted to the ambient environment, rather than the content itself), more (or all) of the display codes could be reserved for dark values and/or fewer total codes (and, potentially, fewer bits) could be used. In a case where the user is adapted to the content (e.g., the aforementioned theater/HMD case), the result is similar, since the user's response is not instantaneous, so the user will be adapted (mostly) to the preceding frames' brightness level. (However, it is noted that, in instances where the user is adapted to the content, and the content has been dim a long while, it may become necessary to actually allocate more bits to representing the dark content.) Likewise, in a case where an encoded frame of content comprises no blue pixels, none of the display codes would need to be reserved for color intensity values used to produce blue output pixels, thereby also allowing for fewer total codes (and, potentially, fewer bits) to be used. These are but several examples of the types of additional efficiencies (e.g., fewer display codes requiring fewer bits for encoding) that may be gained through the process of adaptive content encoding.

It should be further mentioned that, many displays have independent: (a) pixel values (e.g., R/G/B pixel values); (b) display colorimetry parameters (e.g., the XYZ definitions of the R/G/B color primaries for the display, as well as the white point and display transfer functions); and/or (c) backlight (or other brightness) modifiers. In order to fully and accurately interpret content brightness, knowledge of the factors (a), (b), and (c) enumerated above for the given display may be used to map the content values into CIE XYZ color space (e.g., scaled according to a desired luminance metric, such as a nit) in order to ensure the modifications implemented by the perceptual model will have the desired effect on the viewer of the display. Further, information from optical and/or non-optical sensor(s) 704 may also include information regarding the distance and or eye location of a viewer of the display, which information may be further used to predict how the content is affecting the viewer's adaptation.

According to some embodiments, modifications determined by the perceptual model 604 may be implemented by changing existing table values (e.g., as stored in one or more calibration LUTs, i.e., tables configured to give the display a 'perfectly' responding tone response curve). Such changes may be performed via looking up the value for the transformed value in the original table, or by modifying the original table 'in place' via a warping technique. For example, the aforementioned black level (and/or white level) adaptation processes may implemented via a warped compression of the values in the table up from black (and/or down from white). In other embodiments, a "re-gamma" and/or a "re-saturation" of the LUTs may be applied in response to the adjustments determined by the perceptual model 604.

As is to be understood, the exact manner in which perceptual model 604 processes information received from the various sources 700/702/704/706/708/710, and how it modifies the resultant display response curve, e.g., by modifying LUT values, including how quickly such modifications take place, are up to the particular implementation and desired effects of a given system.

Figure 8:
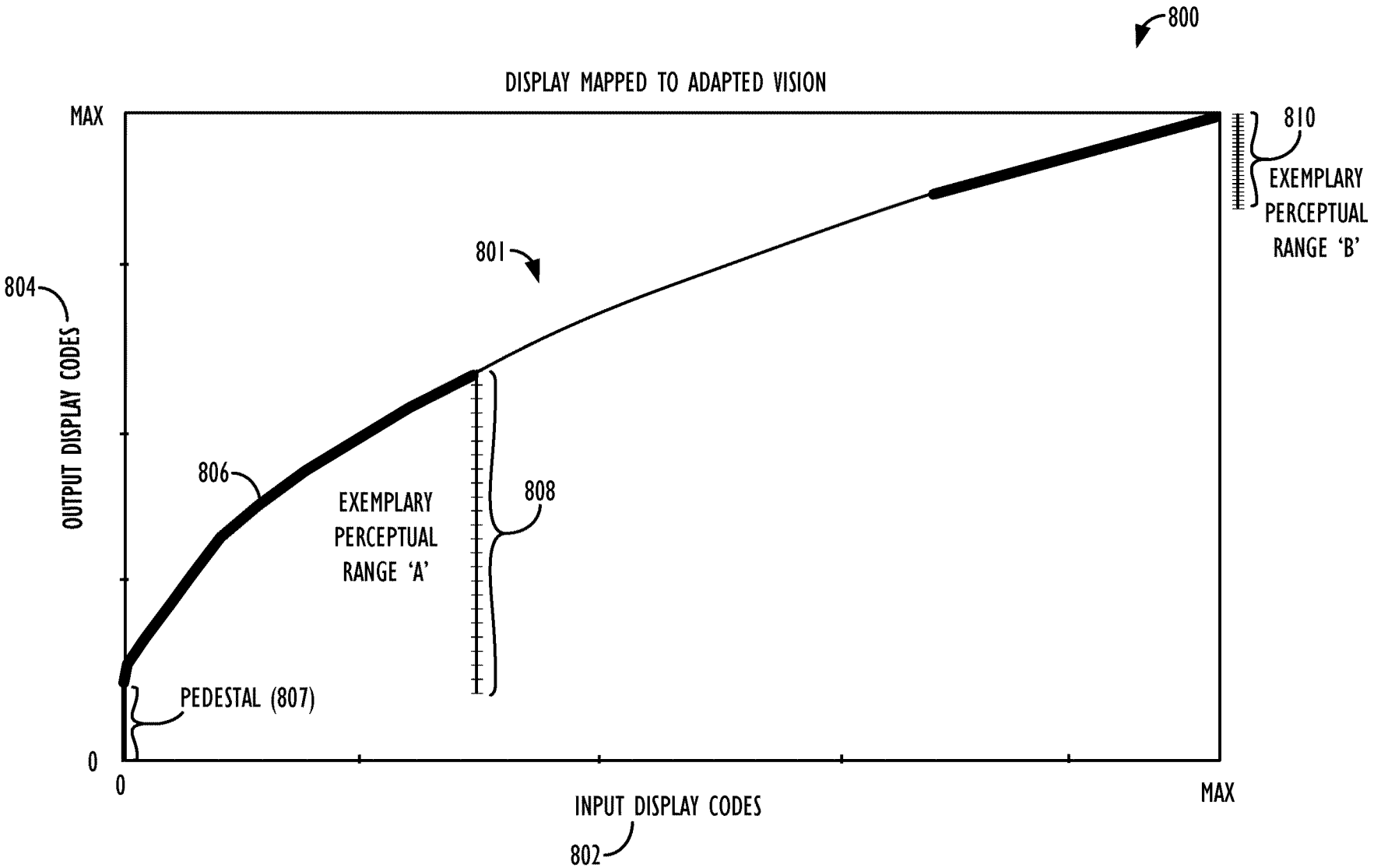
FIG. 8 illustrates a graph representative of an adaptive display transfer function, in accordance with one or more embodiments.

Referring now to FIG. 8, a graph 800 representative of an adaptive display transfer function is illustrated, in accordance with one or more embodiments. In some implementations, display transfer functions may take the form of slope-limited approximations. Slope-limited approximations of transfer functions are commonly used to limit the precision necessary to represent precise functions in linear space, such as naturally occurring functions in linear space or a gamma function in linear space. By way of example, a gamma function usually corresponds to an attribute of human perception. When a high-precision image signal is moved into perceptual space, it may be represented using less information (e.g., fewer bits) and appear to a user as unchanged, due to the non-linear characteristic of human vision (i.e., with finer acuity at the darker end of adaptation), thus, some of the linear codes become perceptually 'redundant,' that is, coding values that are perceived to be identical (i.e., falling into the same perceptual bin) to a viewer. In order to improve efficiency in the representation of the signal, it may be desirable to limit, to the greatest extent possible, the use of perceptually-redundant codes (e.g., the gamma function may be modified to use more codes in an area of higher human perception and fewer codes in an area of lower human perception).

One real-world example occurs in relation to a human's perception of colors, such as levels of black, which occurs because the human eye is more sensitive to gradations of darker regions (e.g., black, etc.) than to gradations of brighter regions (e.g., white, etc.). Due to this difference in sensitivity, it may, in some scenarios, be more efficient to control the gamma function using a scale that mimics human perception. This may, for example, include using more codes for the gamma function in an area of higher human perception (e.g., black regions, etc.) and fewer codes in an area of lower human perception (e.g., white regions, regions that are brighter than black regions, etc.).

In typical computing environments, when it is time to operate on the data, there is a transition from a perceptual space into a linear space (e.g., moving the codes into a linear space). However, the representation of the data in linear space is far more resource demanding, which may effectively reverse the compression provided by the perceptual encoding. For example, ten bits of information in a perceptual space may translate to 27-31 bits (or more) in linear space. For this example, the translation may depend on the transfer function of the perceptual space. This is because the linear requirements are approximately the bit precision of the encoded input signal multiplied by the input signal's gamma exponent. In typical computing environments, the hardware and/or software often lack the capability to operate at the level of precision that may be reflected in the perceptual space. In addition, even if the software and hardware have sufficient capability, a direct translation of the precision may be undesirably computationally expensive.

Thus, in either case, before the display of input signal data, there may be a desire to intelligently limit the precision needed in the processing pipeline to reproduce the input data signal to the viewer in the intended fashion, i.e., such that the viewer's perceived experience aligns with the source content creator's original intent. For example, an 8-bit monotonically incremented gradient signal is perfectly represented (by definition) with 8 bits of data. However, a trivial modification of such a signal, such as an attenuation operation, e.g., multiplying all values by 0.9, will cause most of the formally 8-bit representable values to no longer require the same precision to capture (and 'round trip' through the display pipeline).

Assuming that the content that is being displayed and the level of the viewer's adaptation can be fully and accurately characterized, it has been determined that the human visual system can only differentiate roughly 2^9 (or 512) different levels of brightness. Thus, only 9 bits would be needed to represent the quantized display output levels needed to completely represent human perception at any given moment in time. If the input content is not "High Dynamic Range" in nature, then it is possible that even 8 bits would be sufficient to quantize the various brightness levels that the viewer was capable of responding to at the given moment in time.

According to some embodiments, the perceptual model 604 may be used to consider the various factors described above with reference to FIG. 6 that may have an impact on the viewer's perception at the given moment in time. Then, based on the output of the perceptual model 604, an updated display transfer function 610 may be determined for driving the display 114. The display transfer function may be used to convert between the input signal data values and the voltage values that can be used to drive the display to generate a pixel brightness corresponding to the perceptual bin that the transfer function has mapped the input signal data value to at the given moment in time. In other words, at any adaptation, there are only roughly 2^8 (or 2^9) perceptual bins that can be distinguished between by a viewer. Thus, one goal of the perceptual model 604 is to: determine the viewer's current adaptation; determined what region of the adapted range the content and/or display is modulating; and then map to the transfer function corresponding to that portion of the adapted range, so as to optimally use the display codes (and the bits needed to enumerate them).

According to some embodiments, such as that shown in graph 800 of FIG. 8, the display transfer function 801 may use a simple power function model (e.g., a 1/2.2 power function) to map between the value of the input signal to the viewer's relevant 2^8 (or 2^9) perceptual bins, e.g., as predicted by the perceptual model. The y-axis 804 of graph 800 corresponds to the output content/display codes. The x-axis 802 corresponds to the input content/display codes (i.e., before the perceptually-aware mapping has been performed). In some instances, the display transfer function 801 may sit on top of the so-called "pedestal" 807. As described above, this pedestal value may be due, e.g., to leakage/reflection of light coming off the display screen and/or a combination of other factors.

As may now be understood, because it is sitting above the pedestal 807, the display transfer function 801 deviates from a pure 1/2.2 power function model, which may be more noticeable at the upper (i.e., right-hand side) of the curve 801, which has become nearly linear. As is shown, the display may be able to modulate a wider range of brightness levels than a viewer is currently able to differentiate between. Exemplary Perceptual Range 'A' 808 represents the range of the display's modulation that a viewer may be able to perceive at a given time. Within this range 808, the system may have n-bits worth of display codes (i.e., the codes that are used to encode the content frame currently being displayed) to distribute over the range 808. As illustrated, there are 24 equally-distributed codes over range 808. This use of 24 codes is merely illustrative because, as described above, a given system may have 256 or 512 codes, e.g., to distribute over the viewer's predicted adapted visual range. Preferably, the codes may be perceptually evenly-spaced over the display's modulation range. As another example, in another scenario, Exemplary Perceptual Range 'B' 810 represents the range of the display's modulation that a viewer may be able to perceive at a different time (and/or on a display with a different, e.g., much higher, pedestal). Within this range 810, the system may have the same n-bits worth of display codes to distribute over the range 810. Because the range 810 is smaller than the range 808 illustrated in FIG. 8, the display codes in Exemplary Perceptual Range 'B' 810 are much more closely-spaced. This smaller range may allow the system to provide more coded brightness values (e.g., more than one) per adapted vision perceptual bin, or simply use fewer than the full allotted number of bits. In such cases, the extra bits may be used to perform complimentary techniques, such as LTM, which may be used to help differentiate elements that are intended to be differentiable by the source content author, but which may not be differentiable on a given display and/or in a given viewing environment.

Thus, as may now be understood, only the necessary output display codes need to be coded for, and this range is often less than the entire range of the display transfer function 801. In some instances, e.g., when: (a) the user is adapted to the display (e.g., the viewing environment is dark); (b) the preceding content was at (or close to) the same brightness of the current frame; and (c) the user has had enough time to adapt to the displayed content, then the 2^8 or 2^9) codes may be mapped only to the content of the current frame. As described above, if the content of the current frame happens to only use a fraction of its dynamic range (e.g., only one-fourth of its range), then it may be possible to represent the signal for the frame in even fewer bits (e.g., 7 bits, i.e., using 2^7 codes), though there is some risk to this approach, e.g., if the user's adaptation is not well-known or well-predicted.

Figure 9:
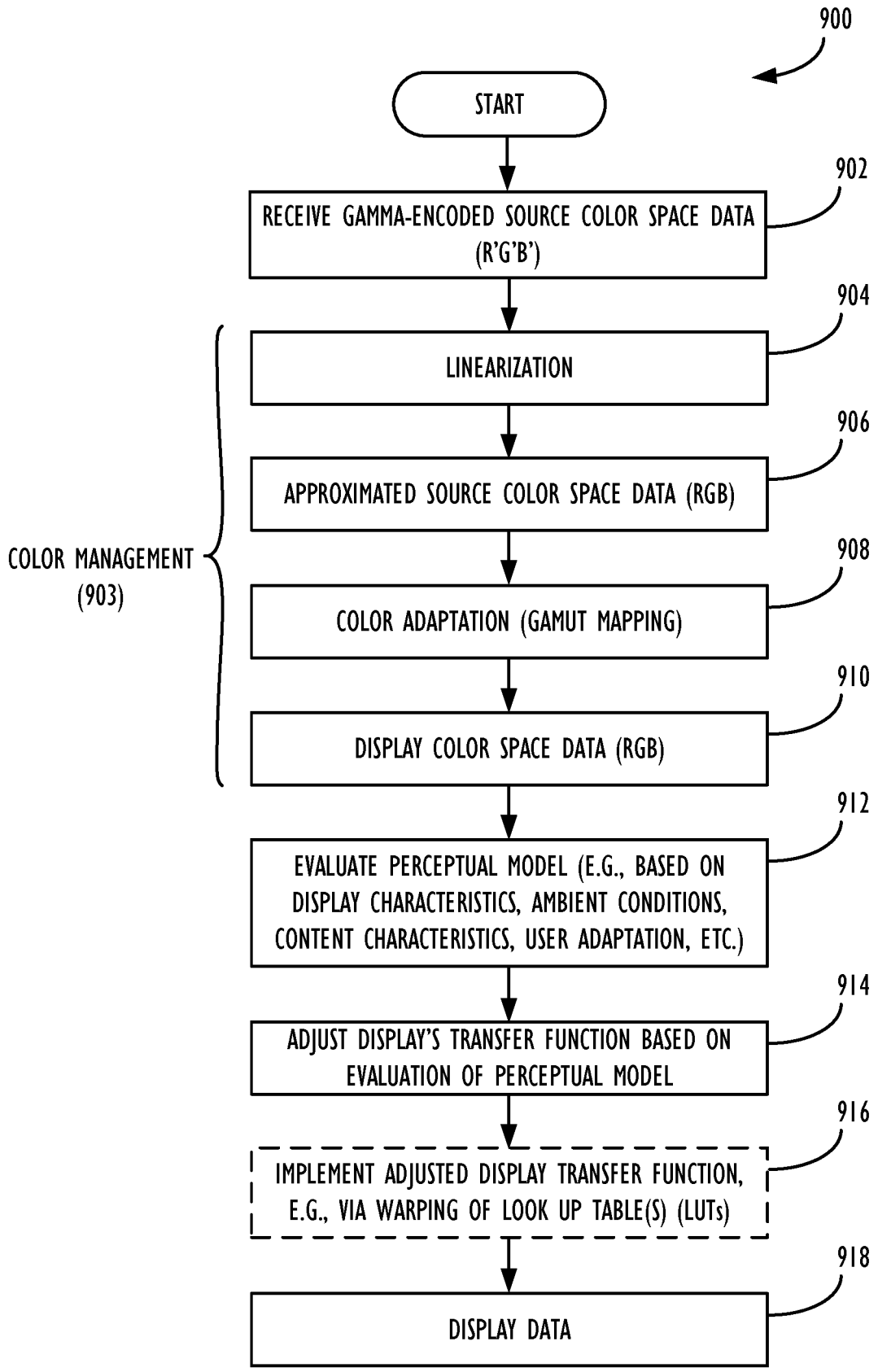
FIG. 9 illustrates, in flowchart form, a process for performing perceptually-aware dynamic display adjustment, in accordance with one or more embodiments.

Referring now to FIG. 9, one embodiment of a process 900 for performing perceptually-aware dynamic display adjustment is shown in flowchart form. The overall goal of some perceptual models may be to understand how the source material will be perceived by a viewer, on the viewer's display, at a given moment in time. First, the display adjustment process may begin by receiving gamma-encoded display signal data tied to a source color space (R'G'B') (Step 902). The apostrophe after a given color channel, such as R', indicates that the information for that color channel is gamma encoded. Next the process may begin a color management process 903. As part of color management process 903, the process may perform a linearization process to attempt to remove the gamma encoding (Step 904). For example, if the data has been encoded with a gamma of (1/2.2), the linearization process may attempt to linearize the data by performing a gamma expansion with a gamma of 2.2. After linearization, the color adaptation process will have a version of the data that is approximately representative of the data as it was in the source color space (RGB) (Step 906). At this point, the process may perform any number of gamut mapping techniques to convert the data from the source color space into the display color space (Step 908). In one embodiment, the gamut mapping may use one or more color adaptation matrices. In other embodiments, a 3DLUT may be applied. The gamut mapping process will result in the model having the data in the display device's color space (Step 910).

At this point, the display adjustment process may evaluate a perceptual model in accordance with the various methods described above (Step 912). For example, the perceptual model may be evaluated based, at least in part, on: received data indicative of the one or more characteristics of the display device, received data indicative of ambient light conditions surrounding the display device, received data indicative of the viewing distance and/or position of the viewer, received data indicative of the one or more characteristics of the content, and/or a predicted adaptation level of a user of the display device. Based on the output of a perceptual model, the white point, black point, and/or gamma of the display may be remapped before the display signal data is sent to the display for reproduction. (As mentioned above, according to some embodiments, the display signal itself may also be adaptively pre-encoded on a per-frame or per-group-of-frames basis, e.g., based on a prediction of the viewer's adaption over time to the content itself.). The display remapping process will result in the adjusting of the transfer function of the display itself (Step 914). According to some embodiments, the new display transfer function may optionally be implemented via the warping of one or more LUTs (Step 916). At this point, the (adaptively) encoded data may be passed to the LUTs to account for the user's current predicted adaptation (and/or any imperfections in the display response of the display device), e.g., by only coding for those content codes that are needed given the user's current predicted adaptation and disregarding other content codes, and then displaying the data on the display device (Step 918). According to some embodiments, as discussed above with reference to animation engine 614, the adjustments to the transfer function of the display may be intelligently implemented over a determined time interval.

Figure 10:
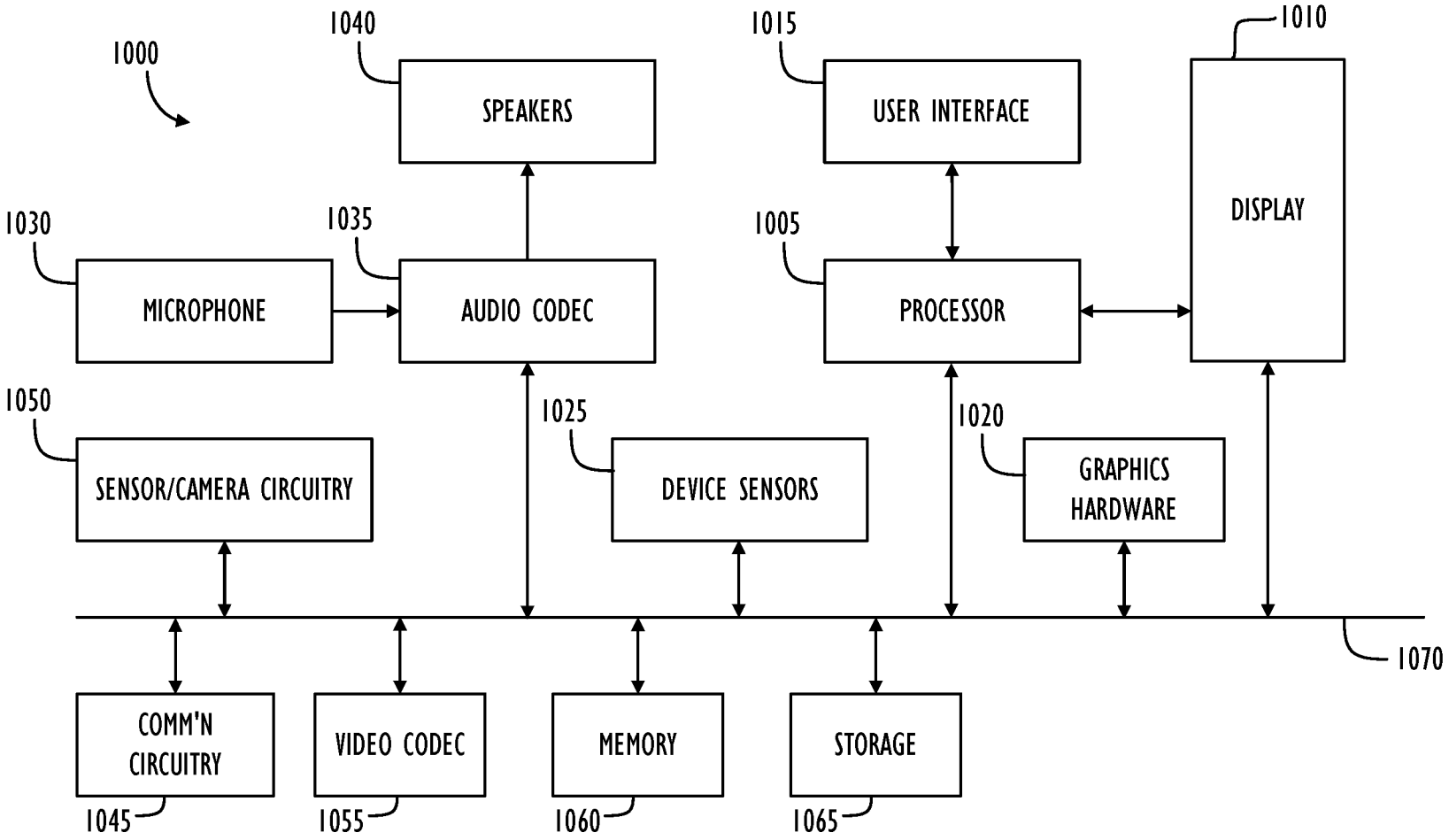
FIG. 10 illustrates a simplified functional block diagram of a device possessing a display, in accordance with one embodiment.

Referring now to FIG. 10, a simplified functional block diagram of a representative electronic device possessing a display is shown, in accordance with some embodiments. Electronic device 1000 could be, for example, a mobile telephone, personal media device, HMD, portable camera, or a tablet, notebook or desktop computer system. As shown, electronic device 1000 may include processor 1005, display 1010, user interface 1015, graphics hardware 1020, device sensors 1025 (e.g., proximity sensor/ambient light sensor, accelerometer and/or gyroscope), microphone 1030, audio codec(s) 1035, speaker(s) 1040, communications circuitry 1045, image sensor/camera circuitry 1050, which may, e.g., comprise multiple camera units/optical sensors having different characteristics (as well as camera units that are housed outside of, but in electronic communication with, device 1000), video codec(s) 1055, memory 1060, storage 1065, and communications bus 1070.

Processor 1005 may execute instructions necessary to carry out or control the operation of many functions performed by device 1000 (e.g., such as the generation and/or processing of signals in accordance with the various embodiments described herein). Processor 1005 may, for instance, drive display 1010 and receive user input from user interface 1015. User interface 1015 can take a variety of forms, such as a button, keypad, dial, a click wheel, keyboard, display screen and/or a touch screen. User interface 1015 could, for example, be the conduit through which a user may view a captured image or video stream and/or indicate particular frame(s) that the user would like to have played/paused, etc., or have particular adjustments applied to (e.g., by clicking on a physical or virtual button at the moment the desired frame is being displayed on the device's display screen).

In one embodiment, display 1010 may display a video stream as it is captured, while processor 1005 and/or graphics hardware 1020 evaluate a perceptual model to determine modifications to the display's transfer function, optionally storing the video stream in memory 1060 and/or storage 1065. Processor 1005 may be a system-on-chip such as those found in mobile devices and include one or more dedicated graphics processing units (GPUs). Processor 1005 may be based on reduced instruction-set computer (RISC) or complex instruction-set computer (CISC) architectures or any other suitable architecture and may include one or more processing cores. Graphics hardware 1020 may be special purpose computational hardware for processing graphics and/or assisting processor 1005 perform computational tasks. In one embodiment, graphics hardware 1020 may include one or more programmable graphics processing units (GPUs).

Image sensor/camera circuitry 1050 may comprise one or more camera units configured to capture images, e.g., images which, if displayed to a viewer, may have an effect on the output of the perceptual model, e.g., in accordance with this disclosure. Output from image sensor/camera circuitry 1050 may be processed, at least in part, by video codec(s) 1055 and/or processor 1005 and/or graphics hardware 1020, and/or a dedicated image processing unit incorporated within circuitry 1050. Images so captured may be stored in memory 1060 and/or storage 1065. Memory 1060 may include one or more different types of media used by processor 1005, graphics hardware 1020, and image sensor/camera circuitry 1050 to perform device functions. For example, memory 1060 may include memory cache, read-only memory (ROM), and/or random access memory (RAM). Storage 1065 may store media (e.g., audio, image and video files), computer program instructions or software, preference information, device profile information, and any other suitable data. Storage 1065 may include one more non-transitory storage mediums including, for example, magnetic disks (fixed, floppy, and removable) and tape, optical media such as CD-ROMs and digital video disks (DVDs), and semiconductor memory devices such as Electrically Programmable Read-Only Memory (EPROM), and Electrically Erasable Programmable Read-Only Memory (EEPROM). Memory 1060 and storage 1065 may be used to retain computer program instructions or code organized into one or more modules and written in any desired computer programming language. When executed by, for example, processor 1005, such computer program code may implement one or more of the methods described herein.

The foregoing description of preferred and other embodiments is not intended to limit or restrict the scope or applicability of the inventive concepts conceived of by the Applicants. As one example, although aspects of the present disclosure focused on human visual perception, it will be appreciated that the teachings of the present disclosure can be applied to other implementations, such as the adaptation of audio transfer functions to a listener's auditory perception. For example, audio content has a dynamic range that might change over time. Similarly, ambient sound levels in the listener's environment may change. Finally, the audio reproduction system may produce only a certain range of sound pressure levels. Analogously to the visual display examples that have been discussed above, by knowing the dynamic range of the audio content being reproduced and the listener's ambient aural environment, the audio content may be transmitted, encoded, etc. using a non-linear transfer function that has been optimized for the given aural scenario (and the predicted auditory adaptation of the listener). For example, a custom, dynamic audio transfer function could change the range mapping of the maximum intensity value of the audio signal (e.g., by changing the reference value), and then encoding the rest of the signal using finer gradations with the same number of bits quantization (or encoding the rest of the signal with the same gradation, but using fewer overall bits) in order to transmit the signal in an optimized fashion—without sacrificing the quality of the user's perception of the audio signal.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method, comprising:

receiving data indicative of one or more characteristics of a display device;

receiving data from one or more optical sensors indicative of ambient light conditions surrounding the display device;

receiving data indicative of one or more characteristics of a content;

evaluating a perceptual model based, at least in part, on: the received data indicative of the one or more characteristics of the display device, the received data indicative of ambient light conditions surrounding the display device, the received data indicative of the one or more characteristics of the content, and a predicted adaptation level of a user of the display device to determine an updated perceptual range for the user of the display device, wherein the updated perceptual range is smaller than a dynamic range of the display device, wherein evaluating the perceptual model comprises determining one or more adjustments to a gamma, black point, white point, or a combination thereof, of the display device;

dynamically adjusting a transfer function for the display device based, at least in part, on the determined one or more adjustments, wherein dynamically adjusting the transfer function comprises distributing a fixed number of display codes over the determined updated perceptual range; and displaying the content on the display device utilizing the adjusted transfer function.

2. The method of claim 1, further comprising: receiving data from one or more non-optical sensors indicative of conditions surrounding the display device, wherein the evaluation of the perceptual model is further based, at least in part, on the received data from the one or more non-optical sensors.

3. The method of claim 1, wherein the act of receiving data from one or more optical sensors indicative of ambient light conditions further comprises receiving data indicative of at least one of: ambient light conditions from an image sensor facing in the direction of a viewer of the display; or ambient light conditions from an image sensor facing away from a viewer of the display.

4. The method of claim 1, wherein the act of dynamically adjusting a transfer function for the display device comprises adjusting one or more values in one or more Look Up Tables (LUTs).

5. The method of claim 1, wherein the determined one or more adjustments to the transfer function for the display device are implemented over a determined time interval.

6. The method of claim 5, wherein the determined time interval is determined based, at least in part, on a predicted adaptation rate of the user of the display device.

7. The method of claim 1, wherein the transfer function for the display comprises a fixed precision transfer function.

8. The method of claim 1, wherein the transfer function for the display comprises a parameterized function of two or more parameters.

9. The method of claim 1, wherein receiving data indicative of one or more characteristics of a content comprises receiving a customized transfer function associated with one or more frames of the content.

10. The method of claim 9, wherein the customized transfer function is further based, at least in part, on at least one of: a brightness level of one or more frames displayed prior to the one or more frames of content; or a brightness level of one or more frames displayed after the one or more frames of content.

11. A non-transitory program storage device comprising instructions stored thereon to cause one or more processors to:

receive data indicative of one or more characteristics of a display device;

receive data from one or more optical sensors indicative of ambient light conditions surrounding the display device;

receive data indicative of one or more characteristics of a content;

evaluate a perceptual model based, at least in part, on: the received data indicative of the one or more characteristics of the display device, the received data indicative of ambient light conditions surrounding the display device, the received data indicative of the one or more characteristics of the content, and a predicted adaptation level of a user of the display device to determine an updated perceptual range for the user of the display device, wherein the updated perceptual range is smaller than a dynamic range of the display device, wherein the instructions to evaluate the perceptual model comprise instructions to determine one or more adjustments to a gamma, black point, white point, or a combination thereof, of the display device;

dynamically adjust a transfer function for the display device based, at least in part, on the determined one or more adjustments, wherein dynamically adjusting the transfer function comprises distributing a fixed number of display codes over the determined updated perceptual range; and cause the content to be displayed on the display device utilizing the adjusted transfer function.

12. The non-transitory program storage device of claim 11, wherein the instructions further comprise instructions to: receive data from one or more non-optical sensors indicative of conditions surrounding the display device, wherein the instructions to evaluate the perceptual model are further based, at least in part, on the received data from the one or more non-optical sensors.

13. The non-transitory program storage device of claim 11, wherein the determined one or more adjustments to the transfer function for the display device are implemented over a determined time interval.

14. The non-transitory program storage device of claim 11, wherein the transfer function for the display comprises a parameterized function of two or more parameters, and wherein at least one of the two or more parameters comprises: white point, black point, or gamma.

15. The non-transitory program storage device of claim 11, wherein the instructions to receive data indicative of one or more characteristics of a content further comprise instructions to cause the one or more processors to receive a customized transfer function associated with one or more frames of the content.

16. A head-mounted display (HMD) device, comprising:

a memory;

a display, wherein the display is configured to be mounted to a head of a user, and wherein the display is characterized by one or more characteristics; and one or more processors operatively coupled to the memory, wherein the one or more processors are configured to execute instructions causing the one or more processors to:

receive data indicative of one or more characteristics of a content;

evaluate a perceptual model based, at least in part, on: the one or more characteristics of the display, the received data indicative of the one or more characteristics of the content, and a predicted adaptation level of a user of the HMD device to determine an updated perceptual range for the user, wherein the updated perceptual range is smaller than a dynamic range of the display, wherein the instructions to evaluate the perceptual model comprise instructions to determine one or more adjustments to a gamma, black point, white point, or a combination thereof, of the display;

dynamically adjust a transfer function for the display based, at least in part, on the determined one or more adjustments, wherein dynamically adjusting the transfer function comprises distributing a fixed number of display codes over the determined updated perceptual range; and cause the content to be displayed on the display utilizing the adjusted transfer function.

17. The device of claim 16, wherein the determined one or more adjustments to the transfer function for the display device are implemented over a determined time interval.

18. The device of claim 16, wherein the transfer function for the display comprises a fixed precision transfer function of nine or less bits.

19. The device of claim 16, wherein the transfer function for the display comprises a parameterized function of two or more parameters, and wherein at least one of the two or more parameters comprises: white point, black point, or gamma.

20. The device of claim 16, wherein the instructions to receive data indicative of one or more characteristics of a content further comprise instructions to cause the one or more processors to receive a customized transfer function associated with one or more frames of the content.

* * * * *